US007386246B2

(12) United States Patent
Yabe

(10) Patent No.: US 7,386,246 B2
(45) Date of Patent: Jun. 10, 2008

(54) JOB PROCESSING METHOD, IMAGE FORMING SYSTEM, IMAGE FORMING APPARATUS AND STORAGE MEDIUM

(75) Inventor: Takashi Yabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 199 days.

(21) Appl. No.: 11/200,059

(22) Filed: Aug. 10, 2005

(65) Prior Publication Data

US 2006/0034630 A1 Feb. 16, 2006

(30) Foreign Application Priority Data

Aug. 10, 2004 (JP) ..... 2004-232849

(51) Int. Cl.
*G03G 15/00* (2006.01)

(52) U.S. Cl. ..... 399/82; 399/79; 399/80; 399/87

(58) Field of Classification Search ..... 399/79, 399/80, 82, 87; 270/58.02, 58.18, 58.19; 271/298

See application file for complete search history.

(56) References Cited

U.S. PATENT DOCUMENTS 5,358,238 A 10/1994 Mandel et al. ..... 271/298
6,064,836 A * 5/2000 Nakamura et al. ..... 399/79
6,160,631 A * 12/2000 Okimoto et al.

FOREIGN PATENT DOCUMENTS

JP 7-230370 8/1995
JP 2-801855 7/1998

* cited by examiner

*Primary Examiner*—David M. Gray
*Assistant Examiner*—Laura K Roth
(74) *Attorney, Agent, or Firm*—Fitzpatrick, Cella, Harper & Scinto

(57) ABSTRACT

A convenient environment flexibly coping with an environment in which an image forming apparatus capable of accepting a plurality of jobs is used can be constructed. For this purpose, in a job processing method of an image forming system including the image forming apparatus capable of accepting a plurality of jobs including a first job, print processing of the first job is performed by the image forming apparatus, and performance of print processing of a second job input after the first job can be prohibited based on checking information including at least any one of information associated with the first job subjected to the print processing and information associated with the second job although print processing of the second job can be performed by the image forming apparatus.

39 Claims, 17 Drawing Sheets

| NON-COLLECTED STATE PREVENTION FUNCTION SETTING | SAME USER MAXIMUM JOB NUMBER LIMIT (JLim_max) | LARGE COPY NUMBER LIMIT (Cmax) | INTERRUPT ALLOWANCE SETTING (Iset) |
|---|---|---|---|
| ON | 5 | 10 | ON |

(IF THIS SYSTEM STATUS KEY IS TOUCHED, SHIFTS TO SCREENS OF FIGS 13 AND 14 WILL BE MADE)

(IF THIS NON-COLLECTED STATE PREVENTION FUNCTION SETTING KEY IS TOUCHED, SHIFT TO SCREEN OF FIG. 7 WILL BE MADE)

FIG. 8

| NON-COLLECTED STATE PREVENTION FUNCTION SETTING | SAME USER MAXIMUM JOB NUMBER LIMIT (JLim_max) | LARGE COPY NUMBER LIMIT (Cmax) | INTERRUPT ALLOWANCE SETTING (Iset) |
|---|---|---|---|
| ON | 5 | 10 | ON |

FIG. 9A

| INTERVAL TIME | JOB NUMBER LIMIT JLim (X) |
|---|---|
| 0 | 5 (MAXIMUM) |
| 1 | 4 |
| 2 TO 5 | 3 |
| 6 TO 10 | 2 |
| 11 TO 20 | 1 |
| 21 OR MORE | 0 |

FIG. 9B

| INTERVAL TIME | JOB NUMBER LIMIT JLim (X) |
|---|---|
| 0 | 10 (MAXIMUM) |
| 1 | 4 |
| 2 TO 5 | 3 |
| 6 TO 10 | 2 |
| 11 TO 20 | 1 |
| 21 OR MORE | 0 |

FIG. 9C

| INTERVAL TIME | JOB NUMBER LIMIT JLim (X) |
|---|---|
| 0 | 10 (MAXIMUM) |
| 1 | 8 |
| 2 TO 5 | 6 |
| 6 TO 10 | 4 |
| 11 TO 20 | 2 |
| 21 OR MORE | 0 |

FIG. 9D

| INTERVAL TIME | JOB NUMBER LIMIT JLim (X) |
|---|---|
| 0 | 10 (MAXIMUM) |
| 1 | 8 |
| 2 TO 5 | 6 |
| 6 TO 10 | 4 |
| 11 TO 15 | 3 |
| 16 TO 20 | 2 |
| 21 TO 30 | 1 |
| 31 OR MORE | 0 |

FIG. 10

| USER NAME | INTERVAL TIME | JOB NUMBER LIMIT JLim (X) |
|---|---|---|
| 01 | 1 | 4 |
| 02 | 0 | 5 (MAXIMUM) |
| ... | ... | ... |
| 11 | 5 | 3 |
| 12 | 25 | 1 |
| ... | ... | ... |
| 15 | 10 | 2 |
| 16 | 50 | 0 |
| ... | ... | ... |

FIG. 11

| USER NAME | POST NAME | JOB NUMBER LIMIT JLim (X) |
|---|---|---|
| 01 | A | *** |
| 02 | B | *** |
| ... | ... | ... |
| 11 | C | *** |
| 12 | A | *** |
| ... | ... | ... |
| 15 | B | *** |
| 16 | B | *** |
| ... | ... | ... |

FIG. 13

| 1501 JOB NAME | 1502 USER NAME | 1503 NUMBER OF COPIES | 1504 DISCHARGE COMPLETION | 1505 RECEPTION COMPLETION | 1506 INTERVAL TIME |
|---|---|---|---|---|---|
| MyJob.DOC | 12 | 5 | COMPLETE | UNCOMPLETED | 0.8 |
| Document1 | 15 | 6 | COMPLETE | UNCOMPLETED | 0.5 |
| Document2 | 15 | 3 | COMPLETE | UNCOMPLETED | 0.2 |
| ... | ... | ... | ... | ... | ... |

FIG. 14A

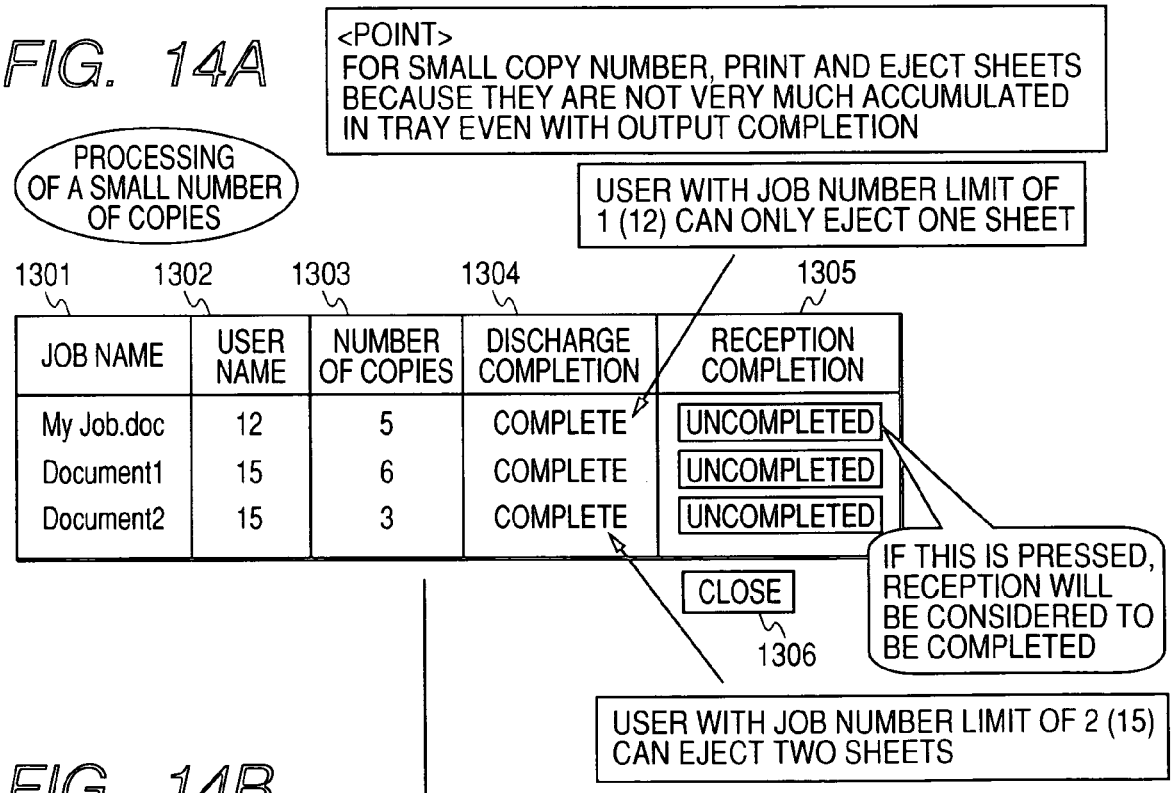

FIG. 14B

| JOB NAME | USER NAME | NUMBER OF COPIES | DISCHARGE COMPLETION | RECEPTION COMPLETION |
|---|---|---|---|---|
| My Job15.doc | 12 | 5 | COMPLETE | COMPLETE |
| Document1 | 15 | 6 | COMPLETE | UNCOMPLETED |
| Document2 | 15 | 3 | COMPLETE | UNCOMPLETED |

CLOSE

USER WITH JOB NUMBER LIMIT OF 1 (12) CAN INPUT NEXT JOB BY DETERMINING THIS TO BE COMPLETE

FIG. 15A

PROCESSING OF A LARGE NUMBER OF COPIES

<POINT>
FOR LARGE COPY NUMBER, WAIT WITHOUT DISCHARGING SHEETS BECAUSE THEY ARE ACCUMULATED IN TRAY WITH OUTPUT COMPLETION. WAITING WITHOUT DISCHARGING SHEETS MAKES IT POSSIBLE TO EASILY CANCEL PRINT WHEN PRINT IS IN FACT UNNECESSARY.

| 1301 JOB NAME | 1302 USER NAME | 1303 NUMBER OF COPIES | 1304 DISCHARGE COMPLETION | 1305 RECEPTION COMPLETION |
|---|---|---|---|---|
| My Job15.doc | 00012 | 15 | UNCOMPLETED CANCEL | UNCOMPLETED |

IF THIS OR START IS PRESSED, DISCHARGE WILL BE STARTED

CLOSE 1306

FIG. 15B

| JOB NAME | USER NAME | NUMBER OF COPIES | DISCHARGE COMPLETION | RECEPTION COMPLETION |
|---|---|---|---|---|
| My Job15.doc | 00012 | 15 | DISCHARGE IN PROGRESS: 1min | UNCOMPLETED |

CLOSE

FIG. 15C

| JOB NAME | USER NAME | NUMBER OF COPIES | DISCHARGE COMPLETION | RECEPTION COMPLETION |
|---|---|---|---|---|
| My Job15.doc | 00012 | 15 | COMPLETE | UNCOMPLETED |

IF THIS IS PRESSED,RECEPTION WILL BE CONSIDERED TO BE COMPLETED

CLOSE

FIG. 15D

| JOB NAME | USER NAME | NUMBER OF COPIES | DISCHARGE COMPLETION | RECEPTION COMPLETION |
|---|---|---|---|---|
| My Job15.doc | 00012 | 15 | COMPLETE | COMPLETE |

CLOSE

FIG. 16A

POD COMPATIBLE

| JOB NAME | USER NAME | NUMBER OF COPIES | DISCHARGE COMPLETION | RECEPTION COMPLETION |
|---|---|---|---|---|
| My Job15.doc | 00012 | 15 | COMPLETE | UNCOMPLETED |

FIG. 16B

| JOB NAME | USER NAME | NUMBER OF COPIES | DISCHARGE COMPLETION | RECEPTION COMPLETION |
|---|---|---|---|---|
| My Job15.doc | 00012 | 15 | COMPLETE | COMPLETE |

DISPLAY NEXT INSTRUCTION IN A MANNER DESCRIBED BELOW BECAUSE RECEPTION IS COMPLETE

FIG. 17

<NEXT TASK PROCEDURE>
MOVE OUTPUT MATTER TO OFFLINE STACKER, AND PERFORM STACKER TASK

FIG. 19

STORAGE MEDIUM SUCH AS FD/CD-ROM

| DIRECTORY INFORMATION |
| --- |
| FIRST DATA PROCESSING PROGRAM<br>GROUP OF PROGRAM CODES CORRESPONDING TO STEPS OF FLOWCHART SHOWN IN FIG. 12 |
| |

MEMORY MAP OF STORAGE MEDIUM

JOB PROCESSING METHOD, IMAGE FORMING SYSTEM, IMAGE FORMING APPARATUS AND STORAGE MEDIUM

BACKGROUND OF THE INVENTION

1. Field of the Invention

The present invention relates to a job processing method of an image forming system including an image forming apparatus capable of accepting a plurality of jobs, an image forming system, an image forming apparatus and a storage medium.

2. Related Background Art

In recent years, office automation has advanced and there have been increased cases where one printer is shared by many persons in an office.

Under such a circumstance, it has been proposed that a distinction is made between users by a mail box bin, a sorter or the like, and the output is managed by a bin for each user as described in Patent Document 1 (Japanese Patent Publication No. 2801855).

However, the method of making a distinction mechanically by the sorter as described above could lead to an increase in size and cost of a machine. It is conceivable that control of communication and control of association between the printer and the sorter, mail box bin and the like will be complicated. There is apprehension that this causes an increase in cost for development of software, which eventually results in an increase in size of an apparatus, leading to an increase in cost.

The situation in which a conventional image forming apparatus having no sorter and sort bin (having only a sheet-discharging tray) is used by two or more persons can be found in, for example, an office environment. In such an environment, it is conceivable that there are users and the like who perform printout but do not pick up output matters printed out (do not collect job outputs). If such a situation occurs, it is conceivable that there is a problem such that output matters printed out are non-collected (left standing) on a sheet-discharging tray, and thus output sheets are accumulated on the sheet-discharging tray.

It is conceivable that the above-mentioned problem causes a problem such that the sheet-discharging tray is full and job outputs overflow, or one's output is obscured and it takes much time to find it out.

In such a situation, there is a possibility that an input print job is randomly output. Therefore, it is conceivable that there is a problem such that an unnecessary job such as an erroneously input print job is output. In this way, there is apprehension that printed matters are non-collected on the sheet-discharging tray, and so on.

SUMMARY OF THE INVENTION

An object of the present invention is to provide a job processing method, an image forming system, an image forming apparatus and a storage medium which can solve the above-mentioned problems.

An object of the present invention is to provide a job processing method, an image forming system, an image forming apparatus and a storage medium which make it possible to construct a convenient environment flexibly coping with an apparatus utilization environment and can solve the above-mentioned problems.

An object of the present invention is to provide a job processing method, an image forming system, an image forming apparatus and a storage medium which increase neither the size of the image forming apparatus nor the cost, and prevent a job output (print sheet) remaining non-collected on a sheet-discharging tray even if two or more persons share one image forming apparatus having only the sheet-discharging tray, thus allowing each user to reliably acquire (collect) his or her own job output (print sheet) easily.

Other objects and features of the present invention will be apparent from, for example, the specification described below and the drawings.

BRIEF DESCRIPTION OF THE DRAWINGS

FIG. 8 shows one example of each piece of setting information regarding a non-collected state prevention function in the image forming apparatus of the present invention;

FIGS. 9A, 9B, 9C and 9D show one example of a setting table for setting a job number limit JLim (X) according to interval time in the embodiment;

FIG. 10 shows one example of user information of the embodiment;

FIG. 11 shows one example of user registration information of the embodiment;

FIG. 13 shows one example of job status information of the embodiment;

FIGS. 14A and 14B are schematic diagrams showing one example of an output job reception check screen for confirming completion of reception of a job output in the embodiment;

FIGS. 15A, 15B, 15C and 15D are schematic diagrams showing one example of the output job reception check screen for confirming completion of reception of a job output in the embodiment;

FIGS. 16A and 16B are schematic diagrams showing one example of the output job reception check screen for confirming completion of reception of a job output in the embodiment;

FIG. 17 is a schematic diagram showing one example of a screen displaying an instruction of next processing for a job;

FIG. 19 is a view explaining a memory map of a storage medium (recording medium) storing various kinds of data processing programs readable by the image forming apparatus according to the present invention.

DESCRIPTION OF THE PREFERRED EMBODIMENTS

First Embodiment

Figure 1:
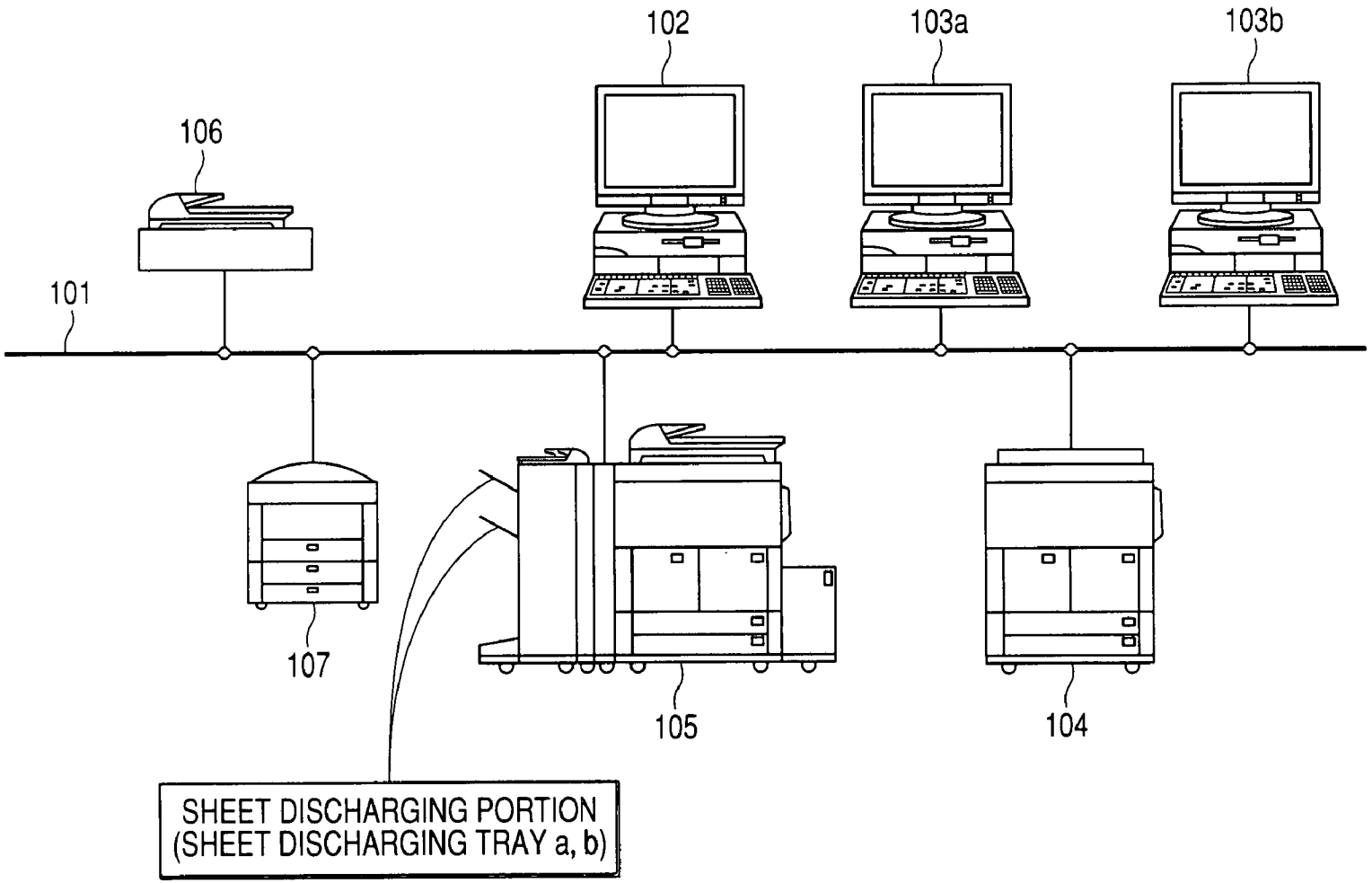
FIG. 1 is a system block diagram showing one example of an image forming system to which an image forming apparatus representing a first embodiment of the present invention is applicable.

FIG. 1 is a system block diagram showing one example of an image forming system to which an image forming apparatus representing a first embodiment of the present invention is applicable.

In FIG. 1, reference numeral 105 denotes an image forming apparatus to which the present invention is applicable. The image forming apparatus 105 is configured to be capable of performing data communication with other apparatuses (scanner apparatus 106, server computer (PC) 102, client computer (PC) 103 (103*a*, 103*b*), another image forming apparatus 104, printer 107 and the like) via a communication medium such as, for example, a network 101, and allows various kinds of data (including image data, control commands, status information and the like) to be exchanged. The image forming apparatus 105 of this embodiment may be a color image forming apparatus capable of forming color images, or may be a black-and-white image forming apparatus.

Figure 2:
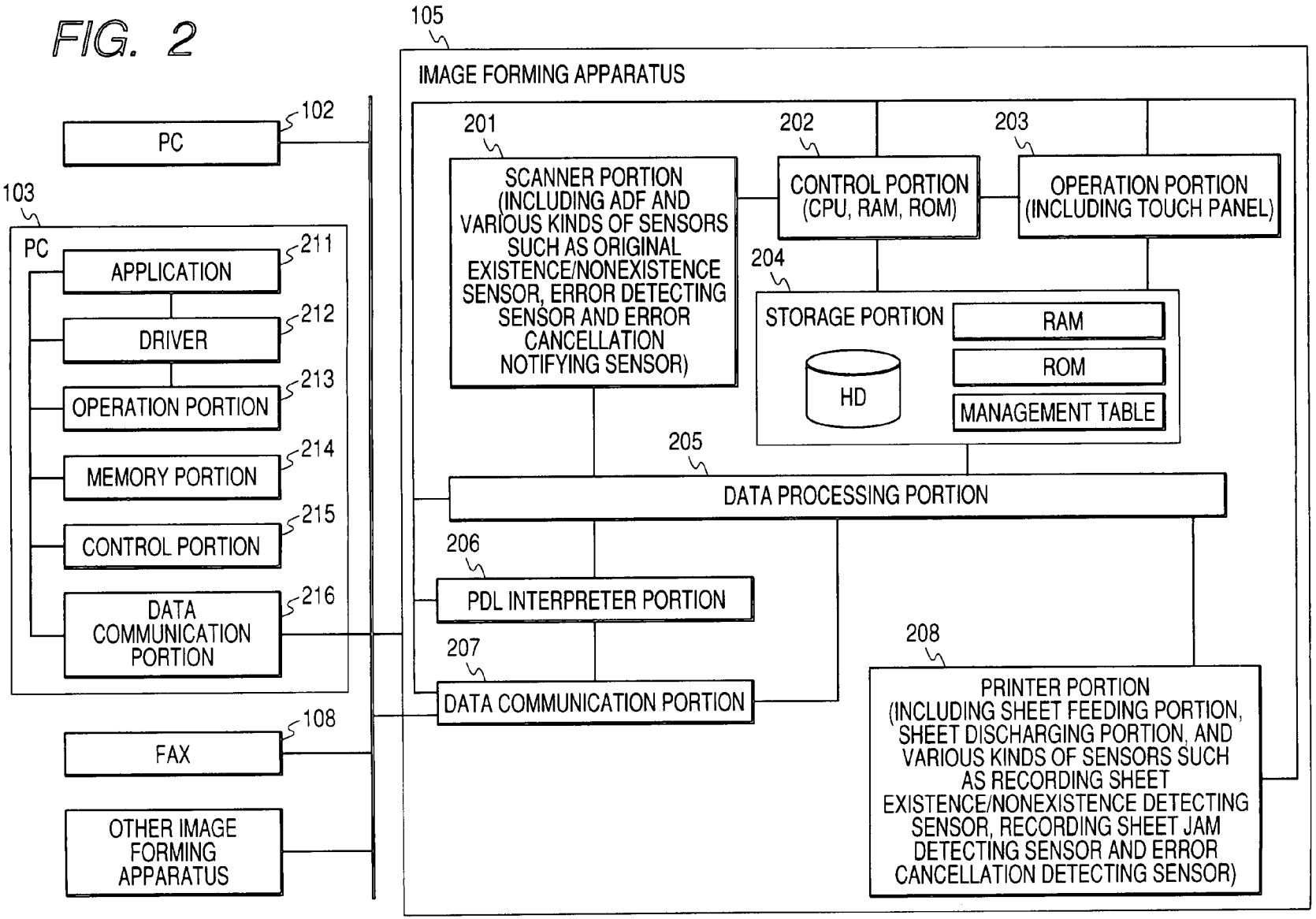
FIG. 2 is a block diagram showing one example of a configuration of the image forming apparatus shown in FIG. 1.

FIG. 2 is a block diagram showing one example of a configuration of the image forming apparatus 105 shown in FIG. 1.

As shown in FIG. 2, the image forming apparatus 105 of this embodiment comprises various kinds of units such as a scanner portion 201, a control portion 202, an operation portion 203, a storage portion 204, a data processing portion 205, a data communication portion 207, a PDL interpreter portion 206 and a printer portion 208.

The control portion 202 collectively controls these units.

The scanner portion 201 performing processing of reading an original has an automatic original feeding apparatus (ADF) capable of feeding a bundle of originals set in an original tray (not shown) to an original reading position sequentially on a one-by-one basis (the scanner portion 201 of the present invention may have a configuration in which the ADF is not mounted), and comprises an original existence/nonexistence sensor detecting whether an original to be read is set or not, i.e. detecting existence/nonexistence of an original, an error detecting sensor detecting whether an error such as an original jam occurs or not, and an error cancellation detecting sensor detecting whether the error gas been cancelled by a user or not (e.g. whether an original causing the original jam has been removed by a user or not) when such an error occurs.

The data communication portion 207 exchanges various kinds of data (image data, control commands, status information and the like) with other apparatuses such as the PC 102, the PC 103, a facsimile apparatus 108 (not shown in FIG. 1) and other image forming apparatuses (e.g. digital multiple function machine 104, printer 107 and the like) via a predetermined communication medium such as the network 101, and makes it possible to receive the data from other apparatuses and send data of its own apparatus to other apparatuses.

The PDL interpreter portion 206 analyzes PDL (printer description language) data received from the data communication portion 207, subjects the data to bit map spread processing, and so on.

The data processing portion 205 performs various kinds of image processing such as, for example, scaling processing and layout processing of image data (also referred to as job data) from the scanner portion 201, image data (also referred to as job data) received from external apparatuses (PCs 102 and 103, facsimile apparatus, other image forming apparatuses and the like) by the data communication portion 207, and the like under print conditions set by the user (under print conditions set by the user via a printer driver of the PC in the case of data from the PC, and under print conditions set via the operation portion 203 of its own apparatus in the case of data from the scanner portion 201), and performs data compression processing and extension processing.

The storage portion 204 has a memory unit (HD in FIG. 2) such as a hard disk apparatus (HD) capable of storing a plurality of job data, and stores, for example, image data from the scanner portion 201 and image data received from the external apparatus by way of the data communication portion 207 in the HD.

When image data is stored in the HD, the image data is stored by way of the data processing portion 205, but it may be stored in the HD after being subjected predetermined processing at the data processing portion 205, or it can be stored in a state of raw data without being particularly processed. The storage portion 204 comprises a management table portion storing various kinds of management table data managed in this embodiment, which will be described later, and further comprises a RAM, a ROM and the like.

The operation portion 203 comprises a touch panel display such as a liquid crystal display portion, comprises so called a soft key and a mechanical hard key, and functions as a user interface unit with a user operating the image forming apparatus 105.

The printer portion 208 performs print processing of image data from the scanner portion 201 and image data received from the external apparatus by the data communication portion 207 under print conditions from the user. In this embodiment, image data from the scanner portion 201 and image data from the external apparatus are stored in the HD of the storage portion 204, read from the HD, and subjected to print processing by way of the data processing portion 205, but the image data may be directly printed without passing through such units.

The printer portion 208 comprises a plurality of sheet feeding cassettes and allows a recording sheet to be selectively fed. Further, the printer portion 208 comprises a sheet treating unit capable of subjecting a recording sheet having an image formed thereon to sheet processing (also referred to as post-processing) such as sort processing (assortment processing), staple processing, punch processing, folding processing and binding processing, and subjects a job to be printed to post-processing set by the unit using the unit. The printer portion 208 comprises one or more sheet discharging portion (also referred to as sheet discharging pin or sheet-discharging tray) stacking recording sheets on which images have been already formed, and allows the recording sheet having an image formed thereon to be selectively discharged to the sheet discharging portion.

The image forming apparatus 105 of this embodiment may be a type comprising only one sheet-discharging tray described above, or may be a type comprising two or more such sheet-discharging trays. The printer portion 208 comprises a recording sheet existence/nonexistence detecting sensor for checking whether recording sheets exist or not, checking the residual amount of recording sheets, and checking a media type such as a size and type of the recording sheet in the sheet feeding portion (also referred to as sheet feeding cassette). Further, the printer portion 208 comprises an error detecting sensor for detecting an error such as a recording sheet jam or staple jam if such an error occurs in the printer portion 208. The printer portion 208 comprises a sheet discharging detecting sensor detecting a stack state (also referred to as containment state) of recording sheets in the above-mentioned sheet discharging portion, and comprises a sheet discharging detecting sensor detecting various kinds of statuses of the sheet discharging portion, which detects whether or not recording sheets exist on the sheet-discharging tray, detects the residual amount of recording sheets existing on the sheet-discharging tray, and detects a sheet-discharging tray full load state such as an amount exceeding the amount of recording sheets loadable at a time.

Further, the printer portion 208 is applicable to the present invention whether it is of the laser beam type, electrophotographic type other than the laser beam type (e.g. LED type), liquid crystal shutter type, inkjet type, thermal transfer type, sublimation type or any other print type.

The control portion 202 makes it possible to perform data communication with various kinds of units described above via an internal signal line, is configured to be capable of, for example, acquiring error information and error cancellation information from the scanner portion 201 and the printer portion 208, acquiring user setting information from the operation portion 203, acquiring various kinds of pieces of status information of the sheet feeding portion of the printer portion 208 from the sensor on the sheet feeding portion side, and acquiring status information of the sheet discharging portion of the printer portion 208 from the sensor on the sheet discharging portion side, and collectively controls overall various kinds of operations to be conducted by the units.

The control portion 202 practically controls data management of a management table such as writing of information into the management table, and deletion, update and change of information based on setting by the user described later.

The image forming apparatus 105 consisting of various kinds of such unit configurations has a copy function of printing job data from the scanner portion 201 by the printer portion 208 via the storage portion 204, a print function of printing job data received from an external apparatus such as a computer via the data communication portion 207 by the printer portion 208 via the storage portion 204, a network scanner function, a data transmission function and a facsimile function.

Further, the image forming apparatus 105 has a box function in which image data input from the scanner portion 201 and image data input from the external apparatus are stored and held in the storage portion 204 instead of printing the image data immediately after they are input, and desired job data is read out from the hard disk in response to the user operation from the operation portion 203 and made printable by the printer 208 under user's desired conditions set by the user via the operation portion.

The control portion 202 controls a plurality functions described above to be capable of being performed selectively according to instructions from the user. The control portion 202 comprises a memory such as a ROM or RAM storing various kinds of program codes for processing of a flowchart described later, and the like, and a CPU of the control portion 202 performs control so that various kinds of programs stored in this memory are read out and desired processing and operations are performed by the units under control.

The image forming apparatus 105 of this embodiment is described with the assumption that it is principally so called a multiple function apparatus (multifunction peripheral, also referred to simply as MFP) having a plurality of functions as described above, but the image forming apparatus 105 may be a single function type image forming apparatus (single function peripheral, also referred to simply as SFP) having, for example, only the print function of a plurality of functions described above. An example in which the image forming apparatus 105 is so called a common housing type image forming apparatus comprising all of the above-described units in the interior of the image forming apparatus 105 is described, but the image forming apparatus 105 may be so called separate type image forming apparatus in which the scanner portion 201 and the printer portion 208 are mutually independently installed.

In this way, this embodiment is applicable to all system configurations, apparatus configurations and function configurations, and may have any configuration as long as various kinds of configurations described later can be realized.

The PC 103 of the image forming system has an application function portion 211 for various kinds of applications such as document composition software and spreadsheet software, a printer driver function portion 212 for setting print conditions of job data to be printed, and the like, for the image forming apparatus 105, an operation portion 213 comprising a display, a mouse, a keyboard and the like, and a memory portion 214 storing various kinds of data including document data and the like printable at the image forming apparatus 105. The PC 103 comprises a data communication portion 216 for making it possible to perform data communication of various kinds of data including such data with an apparatus situated outside when seen from the PC, such as the image forming apparatus 105. The PC 103 comprises a control portion 215 overall controlling such units possessed by the PC.

The PCs 103 and 102 shown in FIG. 1 may be of the same type, or may be configured to have mutually different functions, but they may be of any type as long as at the minimum, various kinds of data can be exchanged with the image forming apparatus 105, instructions can be provided so that desired job data is sent to the image forming apparatus 105 together with print condition data, and subjected to print processing by the image forming apparatus 105 via a memory such as the above-mentioned hard disk, and remote control for achieving various kinds of processing described later can be realized.

Figure 3:
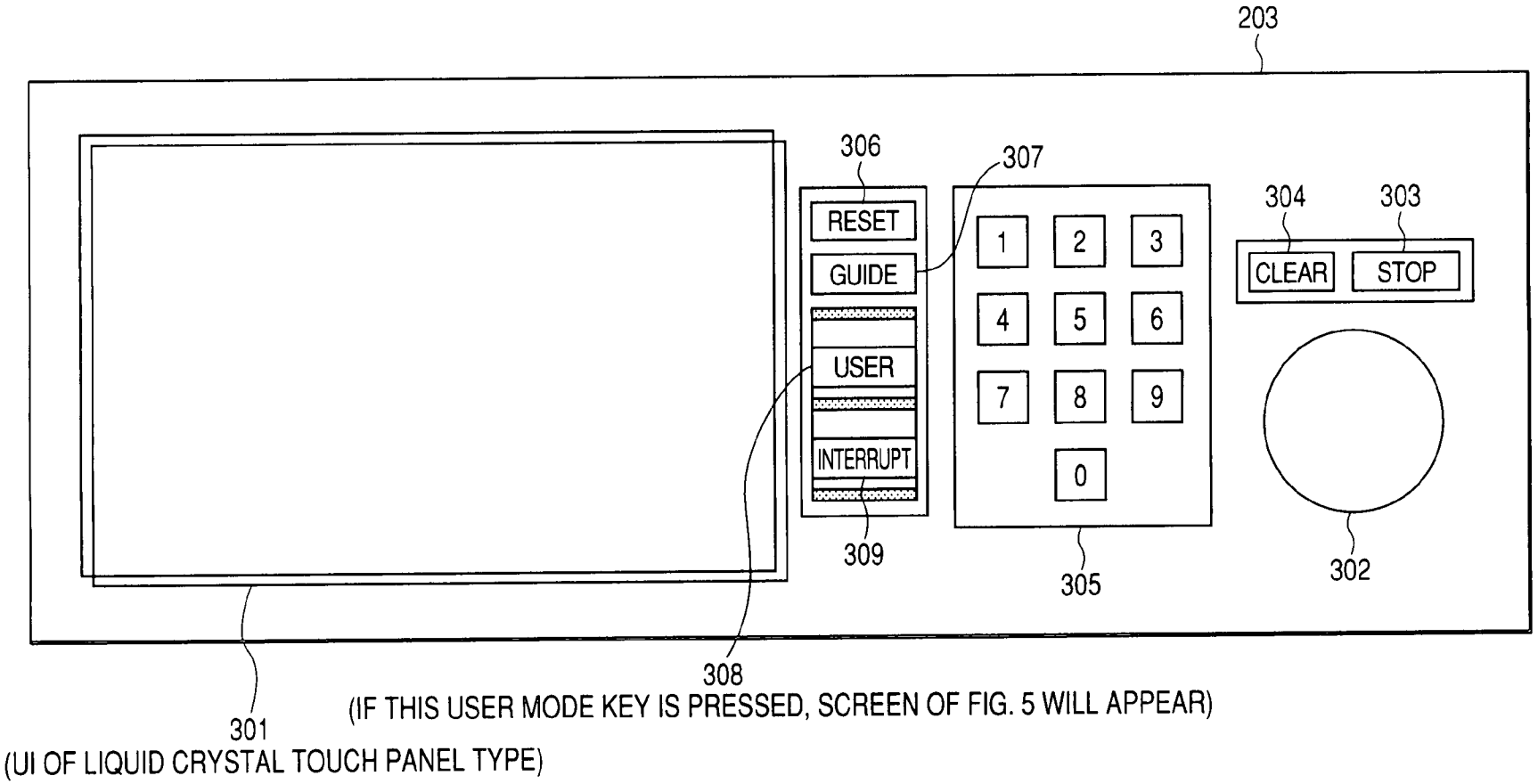
FIG. 3 is a plan view showing one example of an outline of an operation portion of the image forming apparatus shown in FIG. 2.

FIG. 3 is a plan view showing one example of an outline of the operation portion 203 of the image forming apparatus 105 shown in FIG. 2.

As shown in FIG. 3, the operation portion 203 of the image forming apparatus 105 of this embodiment comprises a display portion 301 of a liquid crystal display having a touch panel on the surface, as one example thereof, and the display portion is configured to be capable of realizing a touch panel function having not only a display function allowing information to be provided (displayed) to the user, but also an input function allowing a plurality of operation screens to be selectively switched and displayed on the display portion 301, allowing one or more touch panel keys to be displayed on each operation screen, and allowing instructions from the user to be input when the user directly touches the touch panel key with a finger.

The operation portion 203 comprises so called mechanical hard keys, e.g. a start key 302, a stop key 303, a clear key 304, a ten key 305, a reset key 306, a guide key 307, a user mode key 308, an interrupt key 309, and the like, in addition to the touch panel key as a soft key displayed on the display portion 301, and is configured to be respondent to a user operation from the hard key and configured to be capable of displaying information set via the hard key on the display portion 301.

Figure 5:
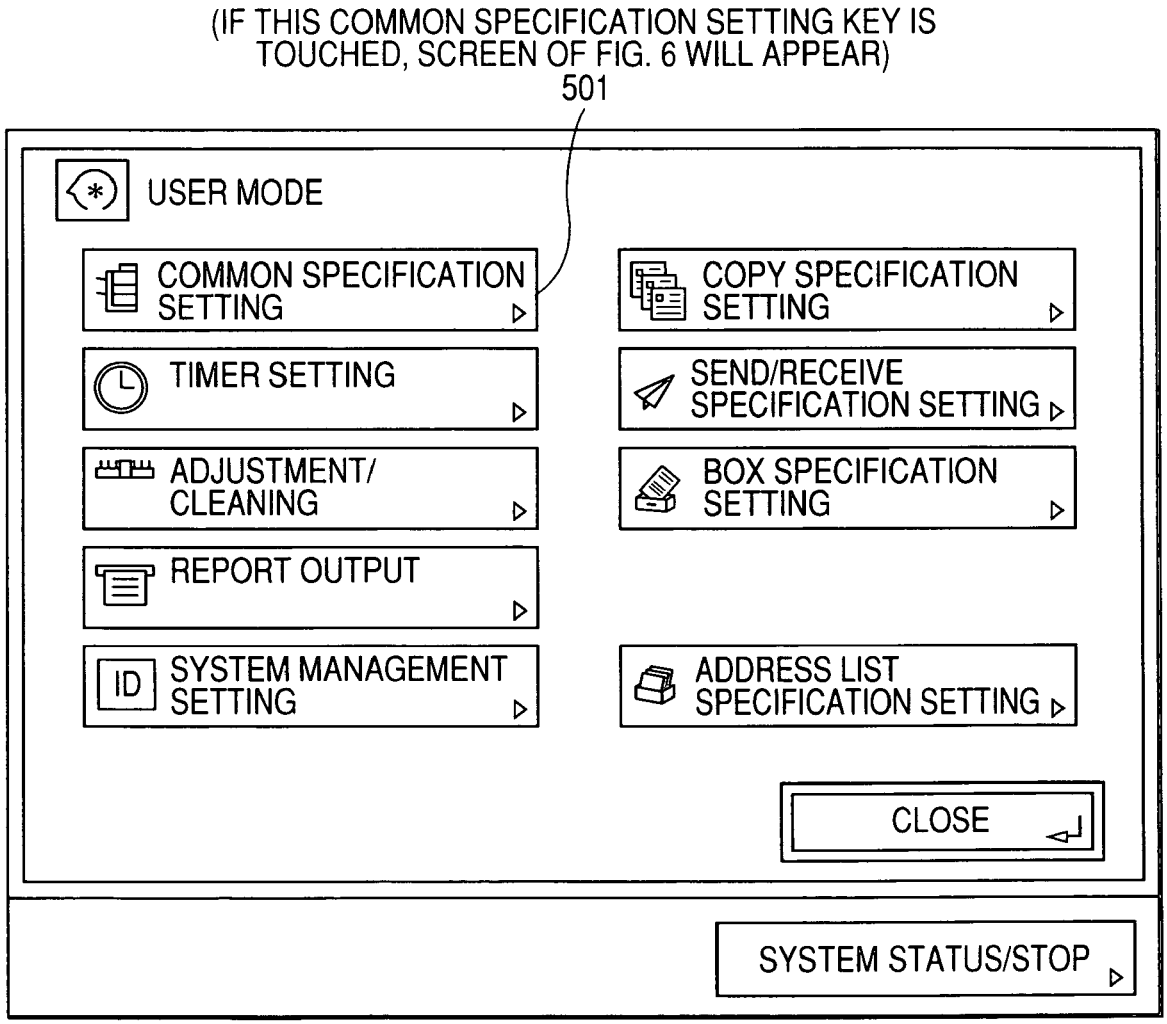
FIG. 5 is a schematic diagram showing one example of a user mode screen which the control portion displays on the display portion in response to a user mode key shown in FIG. 3 being pressed down by a user.

If the user mode key 308 is pressed down by the user, display contents of the display portion 301 are controlled by the control portion 202 so as to display a user mode screen shown in FIG. 5 described layer.

Various kinds of instructions from the user are received via the above operation portion 203, the information is communicated to the control portion 202, and the control portion 202 operably controls the units based on the information from the operation portion 203. The control portion 202 is also responsible for display control of various kinds of operation screens displayed on the display portion 301.

Figure 4:
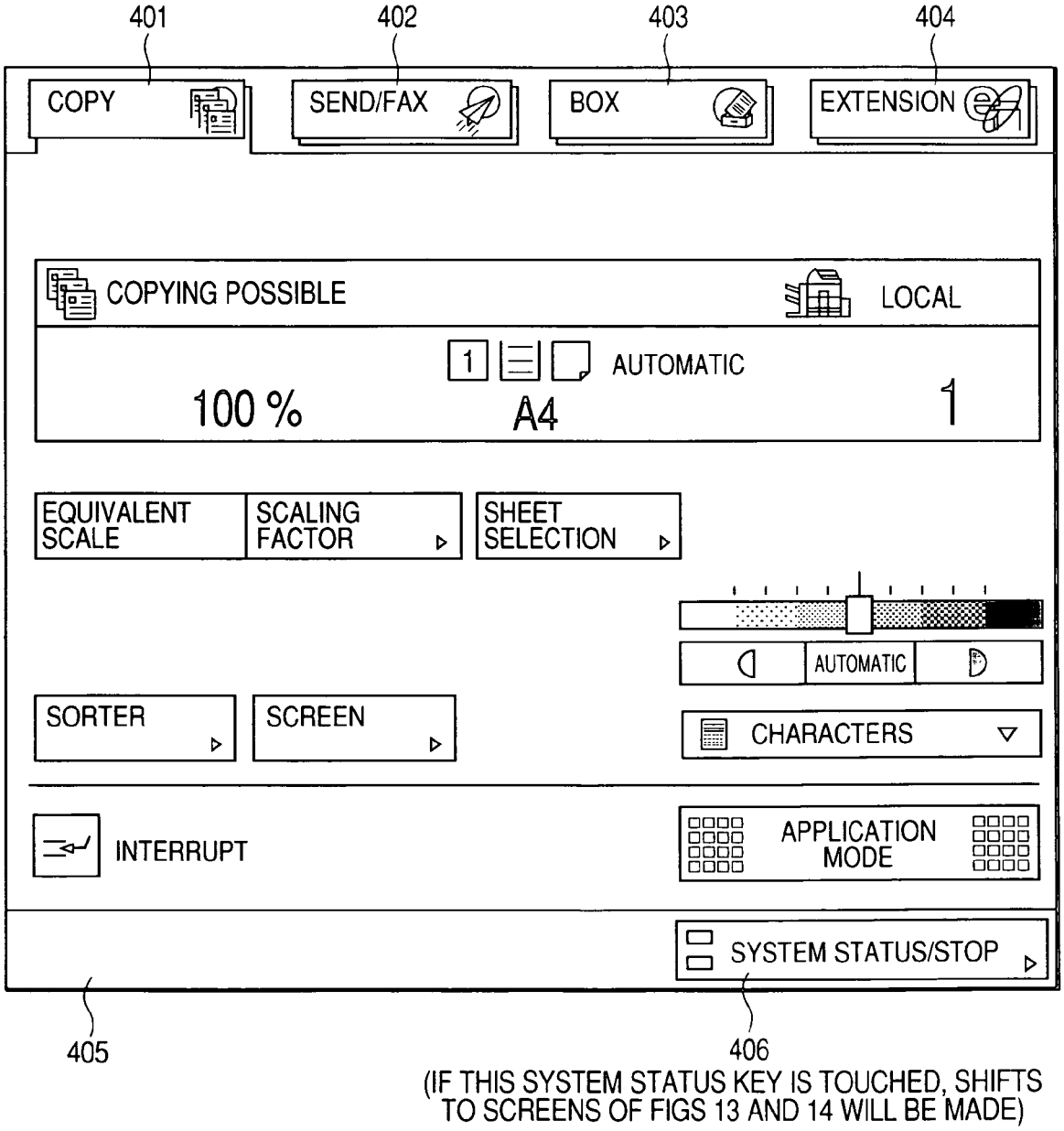
FIG. 4 is a schematic diagram showing one example of an operation screen (example of basic screen) displayed on a display portion of the operation portion of the image forming apparatus shown in FIG. 3 under display control of a control portion of the image forming apparatus.

FIG. 4 is a schematic diagram showing one example of an operation screen (example of basic screen) displayed on the display portion 301 of the operation portion 203 of the image forming apparatus 105 shown in FIG. 3 under display control of the control portion 202 of the image forming apparatus 105.

The display portion 301 shown in FIG. 3 is configured to display thereon a function selecting portion (corresponding to 4 tab buttons 401 to 404 on the screen uppermost part) for the user to select a desired function of a plurality of functions (copy function, transmission function, box function and the like) possessed by the image forming apparatus on the display region uppermost part by the user as shown in FIG. 4. In this example, the copy function is selected by the tab button 401.

Various kinds of print conditions (setting of a scaling factor, setting of a size of a sheet to be output, setting of post-processing such as sort, setting of double side print, setting of print density and the like) in the copy function can be set by the user via this operation screen. The number of print copies and the like can be set in cooperation with the ten key 305.

The display portion 301 has on its lowermost part a status display line 405 for allowing the user to be notified of status information of the image forming apparatus 105, and if an error such as a sheet jam occurs in the image forming apparatus 105, for example, the display region can be notified of information allowing user to identify the specifics of the error occurring in the image forming apparatus 105.

Further, the status line has at its right end a system status key 406, and if this key is pressed down by the user, the display contents of the display portion 301 are controlled by the control portion 202 so as to display an output job reception check screen shown in FIGS. 14A and 15A described later.

FIG. 5 is a schematic diagram showing one example of a user mode screen which the control portion 202 displays on the display portion 301 in response to the user mode key 308 shown in FIG. 3 being pressed down by the user.

Setting of various kinds of operation conditions including how the image forming apparatus 105 is to be operated, and setting of its specifications can be selected and determined by the user via this user mode screen.

In FIG. 5, reference numeral 501 denotes a common specification setting key. For example, if this common specification setting key 501 is pressed down by the user, the control portion 202 performs control so that for example a common specification-setting screen of FIG. 6 for allowing setting regarding a common specification of the image forming apparatus 105 to be performed by the user (suitable for manager and the like in this example) is displayed on the display portion 301.

Figure 6:
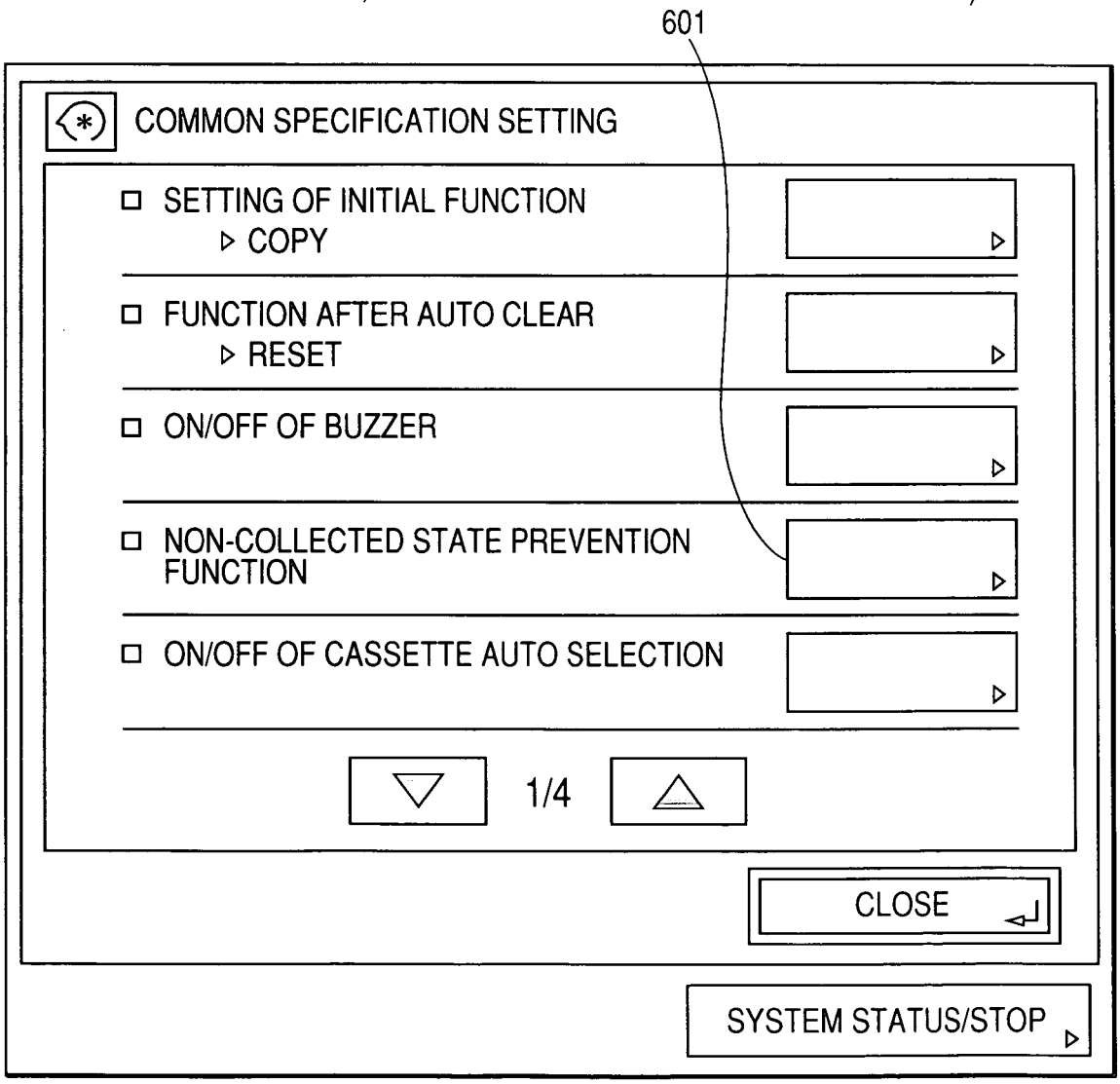
FIG. 6 is a schematic diagram showing one example of a common specification-setting screen which the control portion displays on the display portion in response to a common specification setting key shown in FIG. 5 being pressed down by a user.

FIG. 6 is a schematic diagram showing one example of the common specification-setting screen which the control portion 202 displays on the display portion 301 in response to the common specification setting key 501 shown in FIG. 5 being pressed down by the user.

Setting regarding the common specification of the image forming apparatus 105 can be performed by the user (suitable for manager and the like in this example) via this common specification-setting screen.

In FIG. 6, reference numeral 601 denotes a non-collected state prevention function-setting key. For example, if this non-collected state prevention function-setting key 601 is pressed down by the user, the control portion 202 performs control so as to display on the display portion a non-collected state prevention operation screen 700 shown in FIG. 7.

Figure 7:
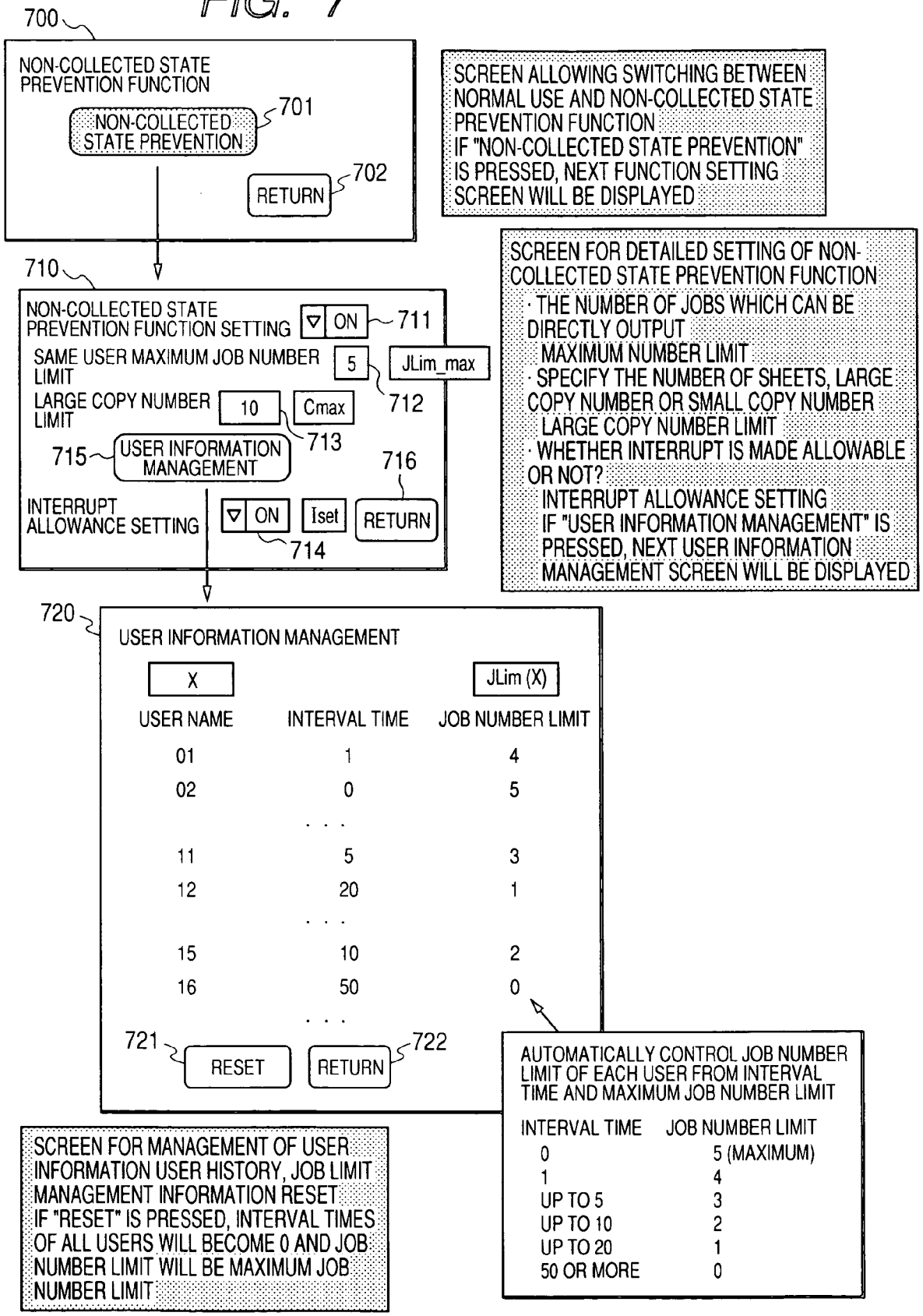
FIG. 7 is a schematic diagram showing a series of screen shifts of a non-collected state prevention function screen in the image forming apparatus of the embodiment.

FIG. 7 is a schematic diagram showing a series of screen shifts of a non-collected state prevention function screen in the image forming apparatus of this embodiment.

First, each setting of non-collected state prevention function is performed on the non-collected state prevention operation screen 700.

In the non-collected state prevention operation screen 700, reference numeral 701 denotes a non-collected state prevention key, and if this non-collected state prevention key 701 is gray (as shown in FIG. 7), it indicates that the non-collected state prevention function is in an ON state. If the non-collected state prevention key 701 is void, it indicates that the non-collected state prevention function is in an OFF state.

If the non-collected state prevention key 701 is pressed down, the control portion 202 performs control so as to display a non-collected state prevention function setting screen 710 on the display portion 301. Detailed setting of the non-collected state prevention function can be performed by this non-collected state prevention function setting screen 710.

If a return key 702 is pressed down, the control portion 202.performs control so that the common specification-setting screen shown in FIG. 6 is displayed on the display portion 301 (the screen is returned to an immediately preceding screen).

Detailed setting by the non-collected state prevention function setting screen 710 will now be described.

This non-collected state prevention function setting screen 710 allows setting of ON/OFF of the non-collected state function by a non-collected state prevention function setting column 711, selection of the same user maximum job number limit JLim_max which is setting of how many jobs the same user can output without waiting a print job by a same user maximum job number limit setting column 712, selection of the large copy number limit Cmax which is setting of the number of sheets (total number of pages) determined to be a large copy number by a large copy number limit setting column 713, and ON/OFF of Iset which is interrupt allowance setting allowing a sheet to be output in an interruptive manner in order to prevent a situation in which if the non-collected state prevention function exists, an urgent document cannot be drawn due to the function, by an interrupt allowance setting column 714.

Each piece of setting information (non-collected state prevention function setting, same user maximum job number limit JLim_max, large copy number limit Cmax and interrupt allowance setting Iset) regarding this non-collected state prevention function has a data structure shown in FIG. 8, and is stored in the storage portion 204 shown in FIG. 2.

FIG. 8 shows one example of each piece of setting information regarding the non-collected state prevention function in the image forming apparatus of the present invention.

If each piece of setting information (non-collected state prevention function setting, same user maximum job number limit JLim_max, large copy number limit Cmax and interrupt allowance setting Iset) regarding this non-collected state prevention function is not set by the user, the control portion 202 performs control so that an initial value stored in the storage portion 204 is set. Here, as one example, the non-collected state prevention function setting is set to "ON", the same user maximum job number limit JLim_max is set to "5", the large copy number limit Cmax is set to "10", and the interrupt allowance setting Iset is set to "ON".

If a user information management key 715 is pressed down, the control portion 202 performs control so as to display a user information management screen 720 on the display portion 301. User information can be managed by this user information management screen 720.

If a return key 716 is pressed down, the control portion 202 performs control so as to display the non-collected state prevention operation screen 700 on the display portion 301 (return the screen to an immediately preceding screen).

Various kinds of non-collected state prevention function settings set at this non-collected state prevention function setting screen 710 are stored in the storage portion 204 by control of the control portion 202.

The user information management screen 720 will now be described.

In the user information management screen 720, job number limits JLim (X) each determined by the control portion 202 from interval time of each user X are managed, the interval time and the job number limit of each user are displayed.

The control portion 202 controls a job limit for each user based on a setting table defining correspondence as shown in FIGS. 9A to 9D so that for example, from the interval time and the same user maximum job number limit JLim_max set at the non-collected state prevention function setting screen 710, a heavy limitation is imposed so that a next job can not be drawn unless the output result of the job is received for a user with long interval time (i.e. user who leaves the job non-collected for a long time), a limitation is alleviated for a user with short interval time (i.e. user who does not leave the job non-collected), and the maximum job number limit JLim_max ("5" in the example of FIG. 7) is assigned to a user with no interval time (user with interval time of "0"), whereby jobs can be prevented from remaining non-collected on the sheet-discharging tray.

The reason why a limitation is imposed by the maximum job number limit even for the user with no interval time (user with interval time of "0") is that jobs accumulated on the sheet-discharging tray are limited to some extent to prevent the sheet-discharging tray from being full. In this embodiment, the interval time is managed on an hour-to-hour basis. Management on an hour-to-hour basis is most efficient in terms of software because otherwise memories of the counter are increased, but if it is desired to set the job number limit more finely according to the interval time, the interval time may be managed on a minute-to-minute basis or on a second-to-second basis.

This user information has a data structure shown in FIG. 10, and is stored in the storage portion 204 shown in FIG. 2.

In the user information management screen 720, reference numeral 721 denotes a reset key, and if this reset key 721 is pressed down, the control portion 202 performs control so that the interval time of each user is reset to "0", and the job number limit is reset to the same user maximum job number limit JLim_max ("5" in the example of FIG. 7).

Here, the configuration in which a reset is made by the reset key 721 is described, but a setting may be made to a setting file (not shown) stored in the storage portion 204 so that a reset is made at every weekend or a reset is made at the end of every month, and the control portion 202 may perform reset control regularly based on the setting file.

There may arise a problem such that if one outputs a job in an office or the like and goes home at a weekend in actuality, a time period between the weekend and the next week is counted as interval time, and a job limitation is imposed when he or she goes to the office on the next week. Accordingly, in order to prevent such a problem, calendar information defining holidays in advance may be registered in the storage portion 204, and the control portion 202 may stop measuring the interval time during a time period defined as a holiday by the calendar information. This prevents a problem such that a time period, during which output results cannot be collected, such as a holiday, is measured as interval time, and an undesired job limitation is imposed, leading to more effective result.

Reference numeral 722 denotes a return key, and if this return key 722 is pressed down, the control portion 202 performs control so as to display the non-collected state prevention-setting screen 710 on the display portion 301 (return the screen to an immediately preceding screen).

FIGS. 9A, 9B, 9C and 9D show one example of a setting table for setting a job number limit JLim (X) according to interval time in the embodiment, and the setting table is stored in the storage portion 204 shown in FIG. 2.

FIG. 9A is a setting table corresponding to the example shown in FIG. 7, but this is only one example, and the setting table may be a setting table shown in FIG. 9B, FIG. 9C or FIG. 9D, or may be or another setting table.

For example, if the same user maximum job number limit JLim_max is changed from "5" to "10", the control portion 202 may perform control so as to change the setting table from the setting table shown in FIG. 9A to the setting table shown in FIG. 9B, FIG. 9C or FIG. 9D. Namely, only the job number limit with interval time of "0" may be changed to the same user maximum job number limit JLim_max "10" as shown in FIG. 9B, a change may be made so that the same user maximum job number limit JLim_max "10" is equally assigned to interval time as shown in FIG. 9C, or a change may be made as shown in FIG. 9D.

Further, the setting table for setting a job number limit appropriate to this interval time may be configured to be capable of being changed manually by the manager.

Further, in this embodiment, the control portion 202 automatically sets a job number limit appropriate to interval time for each user based on this setting table, but the manager may be manually set the job number limit of each user. The control portion 202 may automatically set a job number limit appropriate to interval time for each user only for the user whose job number limit has not been manually set by the manager.

FIG. 10 shows one example of user information of this embodiment, and the user information is stored in the storage portion 204 shown in FIG. 2.

Here, the case where the interval time and the job number limit are managed for each user is shown, but the interval time (average value of interval times of users belonging to a post) and the job number limit may be managed for each post based on user registration information shown in FIG. 11.

FIG. 11 shows one example of user registration information of this embodiment, and the user registration information is stored in the storage portion 204 shown in FIG. 2.

A non-collected state prevention function processing function operation in the image forming apparatus of the present invention will be described below with reference to FIGS. 12A to 15D.

Figure 12:
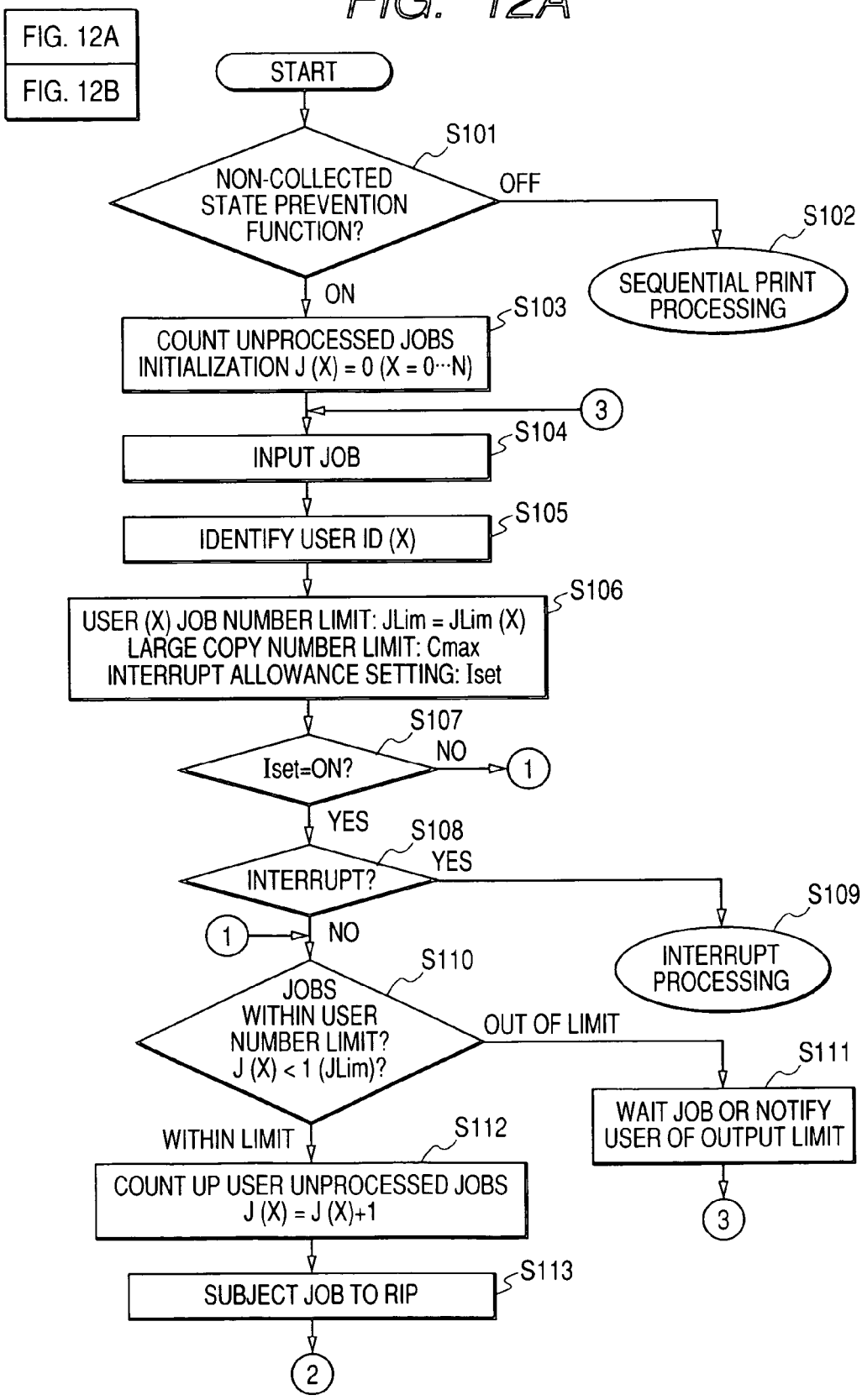
FIG. 12 is comprised of FIGS. 12A and 12B are flowcharts showing one example of a first control processing procedure in the image forming apparatus of the present invention.
Figure 12B:
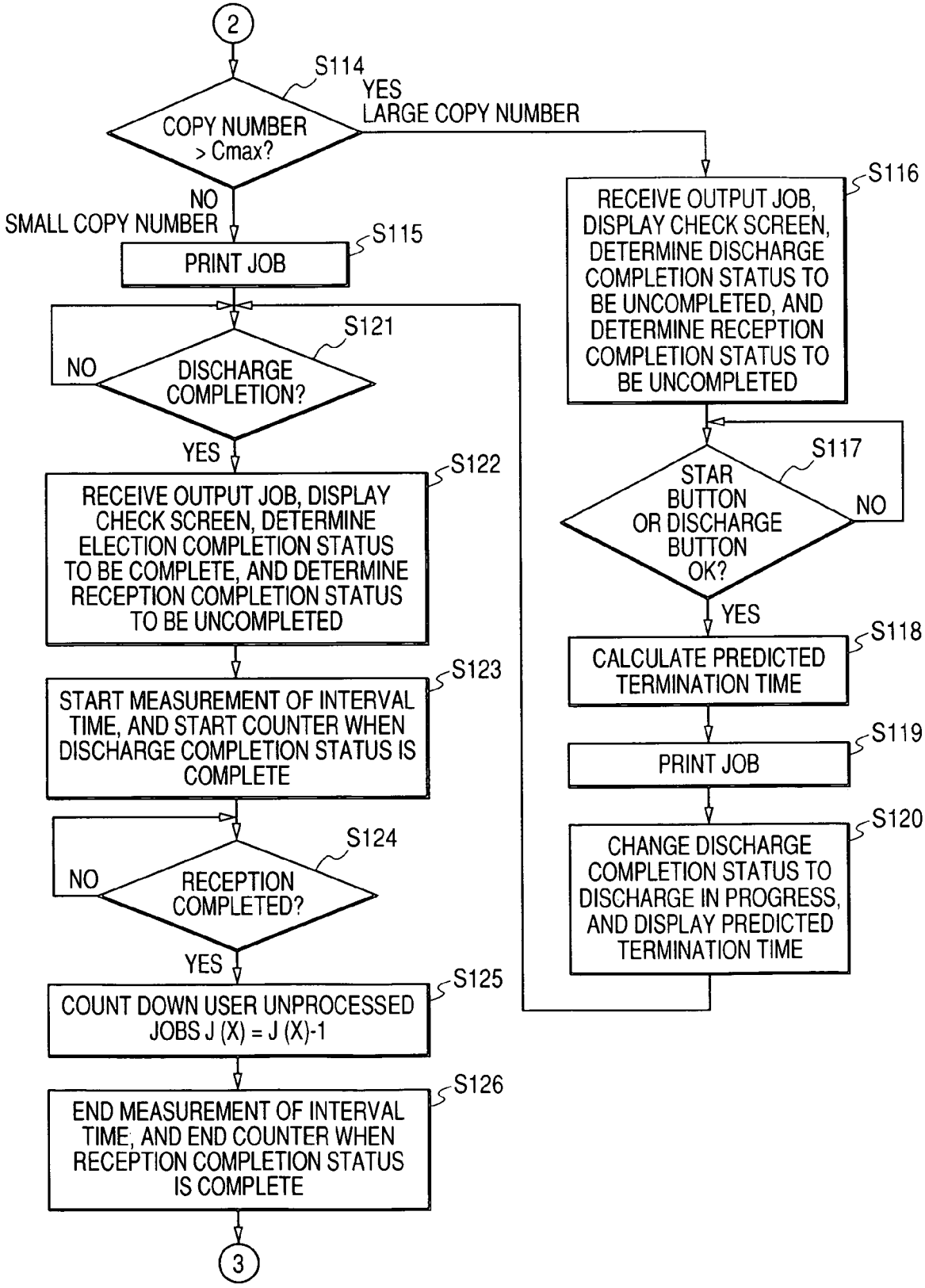

FIGS. 12A and 12B is a flowchart showing one example of a first control processing procedure in the image forming apparatus of the present invention, which corresponds to the non-collected state prevention function processing operation of this embodiment. The CPU of the control portion 202 shown FIG. 2 loads a program stored in the ROM in the control portion 202, the storage portion 204 or another storage medium into the RAM in the control portion 202 and executes the program, whereby processing in this flowchart is achieved. In the figure, reference symbols S101 to S126 denote steps.

Description will be presented below taking as an example the case of settings shown in the non-collected state prevention function setting screen 710 of FIG. 7, i.e. non-collected state prevention function setting "ON", same user maximum job number limit JLim_max ="5", large copy number limit Cmax="10" and interrupt allowance setting Iset="ON", and the user "12" whose job number limit shown in the user information management screen 720 is "1".

When the image forming apparatus 105 starts up, first at step S101, the control portion 202 reads out the non-collected state prevention function setting stored in the storage portion 204, and determines whether the non-collected state prevention function is "ON" or "OFF", and if it determines that the non-collected state prevention-function is "OFF", non-collected state prevention processing is not performed, and processing proceeds to step S102, where print processing is sequentially performed with no job limitation imposed.

If the control portion 202 determines that the non-collected state prevention function is "ON" at step S101, processing proceeds to step S103.

At step S103, the machine is started up, and therefore the control portion 202 first resets each user's unprocessed job count J(X) with no job accumulated, which is held on the RAM in the control portion 202 (resets J(X) to J(X)=0 (X=0, . . . , n)). This processing is performed not just automatically during startup of the machine, but may also be performed individually according to user's instruction. This processing creates a state in which no job is accumulated in the sheet-discharging tray, and thus there is no longer a job for which reception completion of each user is not "complete" (job which has been output but has not been received yet). Initial setting at this step S103 is completed, and input of an actual print job is started at step S104. Here, first, description is presented taking as an example the case where the user 12 issues a print job "MyJob.doc" (hereinafter referred to as "MyJob") of "5" copies (the total number of pages is "5"), which is not a large copy number.

First, when at step S104, the control portion 202 determines that "MyJob" has been input, the control portion 202 checks the user ID of the input job, and sets it to the user (X) at step S105. In the example shown in FIG. 7, the user is "12" and therefore X="12" is set.

Then, at step S106, the control portion 202 reads out user information stored in the storage portion 204 (FIG. 10) and each piece of setting information regarding this non-collected state prevention function (FIG. 8), and checks the job number limit JLim (X), the large copy number limit Cmax and the interrupt allowance setting Iset of the user (X) inputting the job. Here, because of X=12, job number limit JLim (12)="1", large copy number limit Cmax="10" and interrupt allowance setting Iset="ON" are set as the job number limit JLim (X), the large copy number limit Cmax and the interrupt allowance setting Iset corresponding to the user (12) as apparent from FIG. 10.

Then, at step S107, the control portion 202 determines whether the interrupt setting Iset is "ON" or not, and if it determines that the interrupt setting Iset is "OFF", processing proceeds-directly to step S110.

If the control portion 202 determines that the interrupt setting Iset is "ON" at step S107, the control portion 202 performs processing of checking whether there is interrupt processing or not at step S108, and if it determines that an interrupt is set, interrupt processing is performed at step S109.

If the control portion 202 determines that no interrupt is set at step S108, processing proceeds to step S110. In the example shown in FIG. 7, the interrupt allowance setting Iset is "ON", and therefore interrupt checking processing is performed at step S108, and processing proceeds to interrupt processing at step S109 if an interrupt is set, while processing proceeds to step S110 if no interrupt is set.

Then, at step S110, the control portion 202 determines that the job input at step S104 is a job within a user's number limit. Specifically, the control portion 202 determines that the requirement of "J(X)<JLim(X)" is met or not, and if it determines that the requirement of "J(X)<JLim(X)" is not met, it is determined that the job is out of the limit, and processing proceeds to step S111, where the control portion 202 waits a job, or notifies the user of output limitation, i.e. notifies the user that a new job cannot be accepted unless a reception completion status (collection state) is "complete", and processing returns to step S104, where input of a new job is waited. For the notification at step S111, if the input job is a print job from the external apparatus (PC, etc), the control portion 202 performs control so as to send a message showing the notified description to the external apparatus (PC, etc) from which the job is input, and if the input job is a job indicated from the operation portion 203, such as a copy job, or a job of printing data stored in the box, the control portion 202 performs control so as to display a message showing the notified description on the display portion 301 of the operation portion 203.

If the control portion 202 determines that the job input at step S104 is a job within a user's number limit (i.e. "J(X) <JLim (X)") at step S110, processing proceeds to step S112, where the control portion 202 counts up an unprocessed job count (J(X)=J(X)+1), and stores the input job in a queue in the RAM in the storage portion 204 storing unprocessed jobs, and processing proceeds to step S113. The control portion 202 waits a new job while performing processing at step S113 and subsequent steps, and when a job is input, the control portion 202 performs processing at steps S104 to S112 in parallel with processing at step 113 and subsequent steps. Namely, the image forming apparatus 105 can accept a plurality of print jobs which are input, and accumulate the print jobs in the storage portion 204, and sequentially perform the print jobs.

Here, in the example of "MyJob" described above, the job is a job input by the user (12) for the first time, and therefore "J(12)=0" holds and "Jlim(12)=1" holds, and therefore "J(X)<JLim (X)" is true, and it is determined that the job is within the limit, and processing proceeds to step S112, the user's unprocessed job count (the number of print jobs which have been accepted by the image forming apparatus 105 but is not yet in a state in which job output collection is complete) is counted up (counted up to J(12)=J(12)+1, and J(12)=1 holds), and the job is stored in the key. Namely, if the user 12 does not receive a job, and inputs a second job, it is determined at step S110 that the first job is within the limit, and the job is permitted to be performed, but for the second job, J(12)=1 already holds at step S111, and at step S110, "J(X)<JLim (X)" is "false", and it is determined that the job is out of the limit, and the job is withheld from being performed, and processing proceeds to step S111, where the user is notified of wait of the job or output limitation, i.e. the user is notified that a new job cannot be input (accepted) unless the reception completion status (collection state) is "complete" (collection is complete). Namely, when a print job is newly input, the control portion 202 checks the user ID (user information) of the newly input print job, and performs control so as to withhold or permit performance of the newly input print job based on the state of collection of previously input print jobs corresponding to the user ID (performs control so as to withhold the newly input print job from being performed if the number of previously input and uncollected print jobs corresponding to the user ID is larger than the job number limit JLim(X) corresponding to the user ID).

When the unprocessed job is stored in the queue in the RAM in the storage portion 204, the control portion 202 then subjects the job to RIP processing (in which a PLD command of the job is formed in to a raster and spread in the RAM in the storage portion 204, and further job data received from the scanner portion 201 is stored in the RAM in the storage portion 204 in the case of the copy job or the like) at step S113, and processing proceeds to step S114.

Then, the control portion 202 determines the total number of pages P of the job subjected to the RIP processing, and stores the status of this job in job status information in the storage portion 204 and manages the same as shown in FIG. 13, and at step S114, the control portion 202 determines whether the total number of pages P (copies) of this job is larger than the large copy number limit Cmax or not.

FIG. 13 shows one example of job status information of this embodiment, and the job status information is stored in the storage portion 204 shown in FIG. 2.

As shown in FIG. 13, the job status information consist of information such as a job name 1501, a user name 1502, the number of copies 1503, a discharge completion status (job output discharge completion state) 1504, reception completion status state of collection of job output from discharging tray) 1505 and interval time 1506. When a job is to be registered in the job status information, the control portion 202 registers the information with the discharge completion status 1504 and the reception completion status 1505 determined to be "uncompleted" and the interval time 1506 determined to be "0" because the job is neither discharged nor received yet, and if the status of the job is changed, the control portion 202 performs control so as to change information such as the discharge completion status 1504, the reception completion-status 1505 and the interval time 1506. The state of collection from the discharge destination of each job output is stored and managed according to this job status information.

The flowchart of FIGS. 12A and 12B will now be explained below.

The case where the job is a small copy number job (NO at step S114) will be described below.

If the control portion 202 determines at step 114 that the total number of pages P (copies) of the job is not larger than the large copy number limit Cmax (NO at step S114), processing proceeds to step S115, where the control portion 202 outputs the job (subjects the job to print processing), and processing proceeds to step S121.

The control portion 202 performs RIP processing of the unprocessed job stored in the queue in the RAM in the storage portion 204 in parallel with processing at step 114 and subsequent steps according to circumstances while performing processing at step S121 and subsequent steps.

For explaining steps S114 and S115 with the examples of FIG. 7 and "MyJob", the large copy number limit Cmax is set to be "10" and the total number of pages P of the input job MyJob of the user (12) is "5", and therefore "P<Cmax" holds and it is thus determined that-the job is a small copy number job, and processing proceeds to step S115. At step S115, it is determined by the control portion 202 that because of the small copy number, only a small number of sheets are output on the sheet-discharging tray even though the job is output, and the job is not very much obstructive even if it is non-collected, and the job is output (subjected to print processing).

At step S121, the control portion 202 checks completion of the output, i.e. whether discharge of the job is complete. At step S121, the control portion 202 waits until it confirms that discharge is complete, and if the control portion 202 determines that it confirms that discharge is complete, processing proceeds to step S122, where the control portion 202 performs control so as to display on the display portion 301 an output job reception check screen shown in FIG. 14A. Because discharge is complete at this time, the discharge completion status 1504 of the job status information shown in FIG. 13 is changed to "complete" and the output job reception check screen is displayed based on the changed job status information. Namely, the output job reception check screen is displayed wherein the discharge completion status 1304 of the job "MyJob.doc" output at this time is "complete" and the reception completion status 1305 is "uncompleted".

At step S123, the control portion 202 starts measuring interval time at the time when discharge is complete at step S121. The control portion 202 stores this interval time (in-measurement result) in the interval time.1506 on a regular basis.

FIGS. 14A and 14B are schematic diagrams showing one example of the output job reception check screen for checking completion of reception of the job output in this embodiment, which corresponds to the case of processing of a small copy number print job.

As shown in FIGS. 14A and 14B, the control portion 202 performs control so as to display items such as a job name 1301, a user name 1302, the number of copies 1303, a discharge completion status 1304 and a reception completion status 1305 on the output job reception check screen.

As shown in FIG. 14A, control is performed to display the "uncompleted" of the reception completion status 1305 in such a manner that it can be indicated (pressed down) by the user, and if the user pressed down the "uncompleted" of the reception completion status 1304, the control portion 202 confirms that reception of the job is complete, performs control to display the screen with the reception completion status 1305 as "complete" as shown in FIG. 14B, and performs control so that the reception completion status 1505 of the job shown in the status of the job of FIG. 13 is changed to "complete".

In this way, in the output job reception check screen, an input indicating that the job output has been collected from the sheet-discharging tray can be provided for each print job.

Reference numeral 1306 denotes a close key, and if this key is pressed down, the control portion 202 performs control so as to close the output job reception check screen.

The output job reception check screen is displayed on the display portion 301 by control of the control portion 202 if the system status key 406 shown in FIG. 4 is pressed down.

The flowchart of FIG. 12 will now be explained below.

At step S124, the control portion 202 checks whether the reception completion status 1505 of the job is "complete" (whether reception of the job has been completed, "uncompleted" of the reception completion status 1305 on the output job reception check screen has been pressed down by the user, and the reception completion status 1505 of the job is "complete"), and waits until the reception completion status 1505 of the job is "complete", and if the control portion 202 determines that the reception completion status 1505 is "complete", processing proceeds to step S125.

At step S125, because it is confirmed that the user has received the output job, the control portion 202 performs control so as to change "uncompleted" of the reception completion status 1305 on the reception check screen to "complete" and also change the reception completion status 1505 of job status information shown in FIG. 13 to "complete", and counts down the unprocessed job of the user (J(X)=J(X)−1).

When reception is complete at step S124, the control portion 202 changes the reception completion status of "MyJob.doc" to "complete" as shown in FIG. 14B, ends measurement of interval time (i.e. measurement of a time interval after it is confirmed that discharge is completed until it is confirmed that collection is complete), adds the result of the measurement of the interval time to interval time in user information shown in FIG. 10, and updates the job number limit Jlim(X) based on the added interval time (i.e. integrated value) at step S126. Namely, the control portion 202 performs control so as to change the job number limit for each piece of user information based on the above measured interval time. Then, processing returns to step S104, where input of a new job is waited.

For explaining the processing at steps S122 to S126 with the example of "MyJob" described above, in the example described above, the control portion 202 displays information of the job "MyJob.doc" on the output job reception check screen with the reception complete status 1305 as "uncompleted" at step S122 as shown in the first line of FIG. 14A. At step S123, the control portion 202 starts measuring interval time at the time when discharge of the job "MyJob-.doc" is complete.

Then, if the control portion 202 determines at step S124 that "uncompleted" of the reception completion status 1305 of the job "MyJob.doc" has been pressed down, the control portion 202 counts down the unprocessed job of the user (J(X)=J(X)−1) at step S125.

At step S126, the control portion 202 ends measurement of interval time, and performs control so as to change "uncompleted" of the reception completion status 1305 on the job "MyJob.doc" reception check screen to "complete" as shown in the first line of FIG. 14B. Then, processing returns to step S104, where input of a return job is waited.

The flow in which the job is a small copy number job has been described above, and the case where the job is a large copy number job (YES at step S114) will be described below.

If the control portion 202 determines at step S114 that the total number of pages P (copies) is larger than the large copy number limit Cmax (YES at step S114), processing proceeds to step S116, where the control portion 202 performs control so as to withhold the job for preventing a non-collected state because many outputs are accumulated on the sheet-discharging tray if the job is output because of the large copy number,.and the output job reception check screen shown in FIG. 15A is displayed on the display portion 301. At this time, control is performed so that the screen is displayed with the discharge completion status 1304 as "uncompleted" as shown in FIG. 15A directly based on the job status information shown in FIG. 13 because the job is not discharged, and also the screen is displayed with the reception completion status 1305 as "uncompleted" in such a manner that it can be pressed down by the user because the job is not discharged and hence cannot be received, and processing proceeds to step 8117.

FIGS. 15A, 15B, 15C and 15D are schematic diagrams showing one example of the output job reception check screen for checking completion of reception of the job output in this embodiment, which corresponds to the case of processing of a large copy number print job. In FIGS. 15A, 15B, 15C and 15D, components same as those in FIGS. 14A and 14B are given same symbols.

The control portion 202 performs RIP processing of the unprocessed job stored in the queue in the RAM in the storage portion 204 in parallel with processing at step 114 and subsequent steps according to circumstances while performing processing at step S117 and subsequent steps.

Then, at step S117, the control portion 202 waits until the user comes to the image forming apparatus 105 for discharging the job and the area of "uncompleted" of the discharge completion status 1304 of FIG. 15A or the start button 302 is pressed down, and if the control portion 202 determines that,it has been pressed down, processing proceeds to step S118.

At step S118, the control portion 202 calculates an estimated time of the end of output of the job from the total number of pages of the job because how many minutes it takes from now until the RIP-completed job is output can be calculated with the number of sheets output per minute from the image forming apparatus 105 (determined according to print conditions such as color/monochrome, print quality and the paper size).

Then, at step S119, the control portion 202 performs of actual print output (job print) of the job, and at step S120, the control portion 202 performs control to display the result of calculation at step S118 like "discharging: 1 min" on the area of the discharge completion status 1304 as shown in FIG. 15B, and stores the calculation result in the discharge completion status 1504 of FIG. 13, and processing proceeds to processing at step S121.

Namely, even if the control portion 202 permits a newly input print job to be performed (the job is within the limit at step S110), it performs control so as to withhold performing print processing of the print job until an instruction to start printing is input if the number of sheets to be printed for the newly input print job is larger than a predetermined number of sheets (YES at step S114).

The case where the job is a large copy number job (YES at step S114) will be described below taking as an example the case where a job of "MyJob15.doc (hereinafter referred to as "MyJob15")" of which the total number of pages is 15 is input from the user (12).

In the example of setting in FIG. 7 described above, the large copy number limit Cmax is set to "10" and the total number of pages P of the input job "MyJob15" of the user (12) is "15", and therefore "P>Cmax" holds, and at step S114, it is determined that the job is a large copy number job, and processing proceeds to next step S116. At step S116, it is determined by the control portion 202 that many outputs are accumulated on the sheet-discharging tray and are thus obstructive if the job is output because of the large copy number, and control is performed so as to withhold the job for preventing a non-collected state and display an output job reception check screen shown in FIG. 15A on the display portion 301.

As shown in FIG. 15A, control is performed by the control portion 202 to display the "uncompleted" of the discharge completion status 1304 in such a manner that it can be indicated (pressed down) by the user, and if the user presses down the "uncompleted" of the discharge completion status 1304 or the start button 302, the control portion 202 calculates an estimated time of end of output of the job "MyJob15" based on the total number of pages "15" of the job "MyJob15" and the number of sheets capable of being output per minute by the image forming apparatus 105 at step S118. Assume that the result of calculation is 1 minute here.

Then, at step S119, the control portion 202 performs control so that print of the job is actually started, and the result of calculation at step S118 is displayed like "discharging: 1 min" on the area of the discharge completion status 1304 as in FIG. 15B at step S119.

Then, processing proceeds to step S121, where the control portion 202 checks completion of output of the job, i.e. whether discharge is complete as in the case of the small copy number.

If the control portion 202 determines at step S121 that it confirms that discharge is complete, processing proceeds to step S122, where display is provided with the discharge completion status 1304 as "complete" because discharge of the job "MyJob15.doc" is complete as shown in FIG. 15C, and with the reception completion status 1305 as "uncompleted" (which can be pressed down) because reception ours just after discharge.

At step S123, the control portion 202 starts measurement of interval time at the time when discharge is complete at step S121.

At step S124, the control portion 202 checks whether the reception completion status of the job "MyJob15" is complete (whether reception of the job has been completed, and the "uncompleted" of the reception completion status 1305 on the output job reception check screen has been pressed down by the user), and if the control portion determines the reception completion status is "complete", processing proceeds to step S125.

Because it is confirmed that the user has received the output job, the control portion 202 performs control so as to the "uncompleted" of the reception completion status 1305 on the reception check screen to "complete" as shown in FIG. 15D, and counts down the unprocessed job of the user (J(X)=J(X)−1) at step S125.

At step S126, the control portion 202 ends measurement of interval time when reception is complete at step S124. Then, processing returns to step S104, where input of a new job is waited.

In step S124 of FIGS. 12A and 12B, the user operates the screen on the operation portion to check completion of reception of the discharged job as shown in FIGS. 14A, 14B, 15C and 15D, but even if a camera (sensor detecting reception of a sheet on the sheet-discharging tray) is provided on the sheet-discharging tray of the image forming apparatus, it is confirmed that the user has received (collected) the discharged job output from the discharging tray, which print job the collected job output corresponds to is determined at this time, the state of reception (state of collection) of the print job is managed as a state in which reception (collection) is complete, and the user unprocessed job counter is counted down, the same effect can be obtained as a matter of course.

Based on information such as the discharge completion status 1504 of the job, the reception completion status 1504 and the interval time 1506, which is managed with the job status information shown in FIG. 13, the control portion 202 may send mails to the user at fixed time intervals to warn of the non-collected state for preventing a prolonged interval before the user receives the job. In this way, a situation in which the job is left non-collected on the sheet-discharging tray is inhibited even slightly.

In the embodiment described above, the job number limit Jlim(X) of the user is managed using, as the interval time of the user, the integrated value of interval times of past jobs of the user, but the job number limit Jlim(X) of the user may be managed using, as the interval time of the user, the average value of interval times of past jobs of the user or waiting time calculated by a waiting queue after the job output of the user is discharged until it is received, and the same effect can be obtained with this configuration as a matter of course.

Although not shown in the flowchart of FIGS. 12A and 12B, the control portion 202 may perform control so that unless the reception completion status 1505 of the large copy number print job is "complete", a next large copy number print job cannot be accepted. In this way, an output of large quantity can be inhibited from being discharged to inhibit jobs from being accumulated on the sheet-discharging tray.

Second Embodiment

In the first embodiment described above, the function of managing the status (especially reception completion status) of the job to prevent the job from being left non-collected has been described, but when an instruction of offline processing after output by an offline stacker or the like is provided in workflow management of the POD (Print OnDemand), control may be performed to make a determination on the reception complete status of the job, confirm that the output result of the job has been received, and notify the user of an instruction of next processing for the job.

Namely, when the control portion 202 confirms that reception is complete at step S124, it perform control so as to change the reception completion status 1305 of "MyJob-.doc" from "uncompleted" to "complete" as shown in FIGS. 16A and 16B and display on the display portion 301 an instruction of next processing (e.g. instruction of offline processing after output by an offline stacker or the like in workflow management of the POD) for the job as shown in FIG. 17, at step S26 of FIGS. 12A and 12B. In this way, the user can be notified of a next task for the job timely and clearly.

Namely, when the control portion 202 determines the reception completion status (collection state) of a print job to be complete (collected), it performs control so as to provide display providing an indication of next processing to be done by an operator for the job output of the received print job (e.g. "move the output matter to the offline stacker and perform a stacker task").

FIGS. 16A and 16B are schematic diagrams showing one example of the output job reception check screen for checking completion of reception of a job output in this embodiment, which corresponds to the case where an indication of offline processing after output by the offline stacker or the like is provided in workflow management of the POD.

FIG. 17 is a schematic diagram showing one example of a screen displaying an indication of next processing for the job, which corresponds to the indication of offline processing after output by the offline stacker or the like in workflow management of the POD.

As shown above, owing to the non-collected state prevention function in which the control portion 202 performs control so that an input job and the status of the job (whether discharge is complete, whether reception is complete, and the like) are displayed on the display portion 301, input of notification that a job output has been collected from a discharge destination is made possible for each print job, the collection state of a print job for which notification that the job output has been collected from the discharge destination is input is managed as a state in which collection is complete, user information of a print job is checked when the print job is newly input, and performance of the newly input print job is limited or permitted based on the collection state of previously input print jobs corresponding to the user information, N jobs (jobs of job number limit Jlim(X)) can be output, but subsequent jobs cannot be output unless any of reception completion statuses of input N jobs is "complete" when a plurality of jobs are input, thus making it possible to prevent a situation in which jobs are continuously accumulated on the sheet-discharging tray.

The control portion 202 performs control so as to specify (set) the above-mentioned job number limit Jlim(X), whereby the non-collected state can be controlled for each user.

Further, the control portion 202 determines the quantity of the job, and when a job of large quantity (job of which the number of sheets to be printed is larger than the large copy number limit Cmax) is input, the control portion 202 withholds the job being printed until an instruction to start printing is input for prevent outputs from being accumulated on the sheet-discharging tray.

By specifying the large copy number limit Cmax from the large copy number limit setting column 713, it is made possible to make user's desired setting.

Further, the control portion 202 performs control so that time after the discharge completion status 1504 is "complete" until the reception completion status 1505 is "complete" is measured for each user, interval time between output of the job (output of the print sheet) and reception of the job is managed, the output of a user with large interval time is limited, whereby a user who often forgets to receive a job output (collect a job output from the sheet-discharging tray) is deterred from forgetting to receive the job output, and resultantly accumulation of job outputs of print jobs on the sheet-discharging tray can be prevented.

The control portion 202 performs control so as to set the above-mentioned job number limit Jlim(X) (the number of jobs which can be directly output) based on the above-mentioned interval time for user, whereby the level at which the job output is inhibited from being left non-collected can be adjusted.

Further, by switching between ON and OFF of the non-collected state prevention function by the non-collected state prevention function setting column 711 shown FIG. 7, switching between a conventional setting using no non-collected state prevention function and a setting using the non-collected state prevention function can be accomplished, thus making it possible to flexibly switch the operation according to the intended use by the user.

As described above, jobs which can be directly output are managed by managing the reception completion status to prevent an unnecessary output, prevent an output from being left non-collected and prevent accumulation of outputs on the sheet-discharging tray in a simple apparatus having only the sheet-discharging tray, and thus the user can reliably acquire its own job.

When an indication of offline processing after output by the offline stacker is provided in workflow management of the POD, the reception completion status is managed, and therefore the control portion 202 performs control so as to confirm that a job output has been received (collected) from the sheet-discharging tray and output an indication of next processing for the received job output (e.g. display a message indicating next processing on the display portion 301, or output a voice), whereby the user can be timely and clearly notified of a next task for the job output received by the user.

Thus, even if two or more persons share one image forming apparatus without increasing either the size of the image forming apparatus or the cost, job outputs (print sheets) are prevented from being left non-collected on the sheet-discharging tray, and each user can easily acquire (collect) his or her job output (print sheet) reliably.

DETAILED SPECIFIC EXAMPLES OF FIRST AND SECOND EMBODIMENTS

Figure 18:
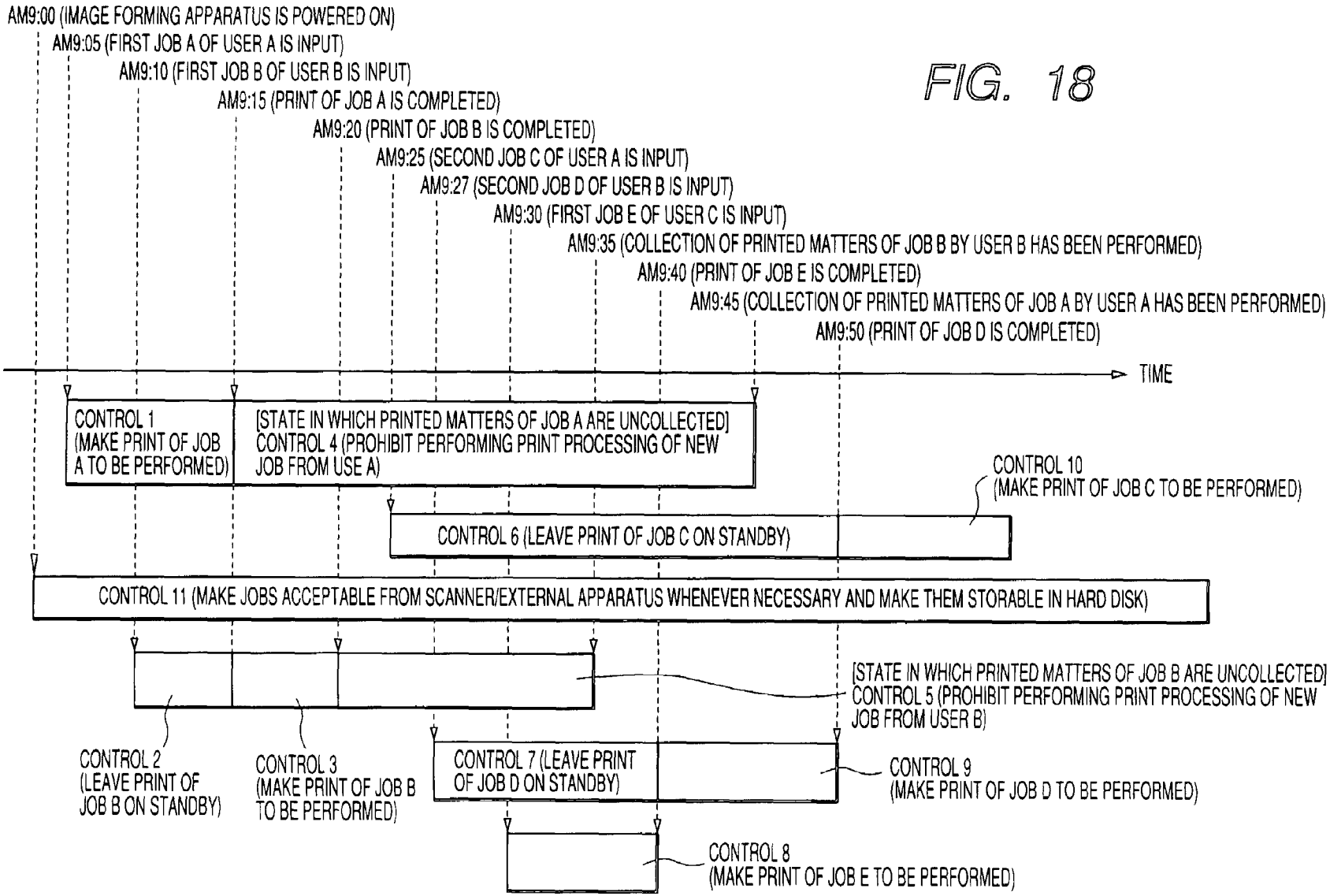
FIG. 18 shows one control example of the embodiment.

For describing the typical configurations of the above-described embodiments in other words, this embodiment has a configuration described below. This will be described with FIG. 18 showing one example of control in this embodiment.

In this embodiment, various kinds of controls described below are performed by the control portion 202 of the image forming apparatus 105 as one example of a job processing method suitable for the image forming system shown in FIG. 1 including the image forming apparatus 105 comprising the storage portion 204 capable of accepting a plurality of jobs.

Assume that the non-collected state prevention function is set (ON) by the user (this user is, for example, a manager) via the key 711 on the screen of FIG. 7 displayed on the display portion 301 of the operation portion 203 as one example of a user interface unit of this embodiment. In response thereto, the-control portion 202 performs control so as to operate the image forming apparatus 105 in a non-collected state prevention mode.

When the image forming apparatus 105 in which the non-collected state prevention mode is set accepts various kinds of jobs, job control described below can be performed by the control portion 202. This will be described using a specific example of FIG. 18. In FIG. 18, the horizontal axis is a time axis.

Assume that the power of the image forming apparatus 105 is turned ON at a.m. 9:00, referring to FIG. 18.

The image forming apparatus 105 of this embodiment is configured to be capable of accepting various kinds of jobs shown in FIG. 18 via a unit possessed by the image forming apparatus 105 itself, such as, for example, the scanner portion 201. It is configured to be capable of accepting the jobs from external apparatuses such as the PCs 102 and 103, the FAX 108 and another image forming apparatus. Of course, it may have only one of the configurations. The control portion 202 stores various kinds of data (image data, print processing condition data, user information and the like) of the accepted jobs in a hard disk of the storage portion 204 whenever necessary.

Assume that a job A is input to the apparatus 105 as a first job from a user A at a.m. 9:05, for example, referring to FIG. 18. The control portion 202 stores data of the job A in the hard disk. As of this time of p.m. 9:05, a job is accepted from the user A for the first time after the power is turned ON. Therefore, in this example, no limitation is imposed on the job of the user A yet. Furthermore, as of this time of a.m. 9:05, no other jobs have been printed yet by the printer portion 208. This state is so called a printable state (also referred to as print ready state or idling state). Assume that resources necessary for print processing of the job A (e.g. consumables such as toners and output sheets) are ready for use. The current status of the image forming apparatus is in a state in which print processing of the job A can be performed by the printer portion 208. Then, based on confirmation information such as the information of the job A itself and status information of the apparatus 105 itself, the control portion 202 reads out print data of the job A from the hard disk, and starts print processing of the job A by the printer portion 208. Namely, at the time of a.m. 9:05 at which the job A is accepted, print of the job A is started.

Such control can be performed by the control portion 202. This corresponds to control 1 at the time of a.m. 9:05 in FIG, 18.

If a job is accepted from the external apparatus such as the PC, user name information included in job information sent together with image data is analyzed to recognize that the job A is a job of the user A.

In the case of a copy job from the scanner portion 201, for example, a user authentication screen is displayed on the display portion 301, and user authentication is demanded from an operator requesting a copy job. At this time, the operator is made to input user name information. After such user authentication is completed, a screen allowing print processing conditions for the copy job to be set, such as a copy basic screen of FIG. 4 is displayed on the display portion 301. When the print processing conditions are set by the user via the print setting screen for the copy job, and the start key 302 is pressed down, the scanner portion 201 is made to read the original of the copy job. In this way, the copy job is accepted. By accepting the copy job via such User authentication processing, who is the user of the copy job can be identified by the control portion 202.

The image forming apparatus 105 of this embodiment comprises not only a printer function of printing external data and a copy function but also a box function. For example, the user presses down a key 403 on the screen of FIG. 4 to select the box function. By using the box function, data of a job from an external computer and a job from the scanner portion 201 can be stored in a box domain in the hard disk of the storage portion 204. In response to a user operation from the operation portion 203, desired output processing, such as print processing or external transmission processing, of data stored in the box domain can be performed in a desired output form. In the box domain, a plurality of boxes (e.g. 100 boxes) are prepared, and user registration can be performed for each box. If a job is output using the box function, a box selection screen for allowing the user to select which box of the boxes storing data to be output is displayed on the display portion 301. Desired data is output from the box selected via the screen. The control portion 202 identifies which user possesses the box selected by the user. By accepting the box job via such a box selection operation by the user, who is the user of the box job can be identified by the control portion 202.

By the method described above, the user of the copy job and box job other than external jobs from the external apparatus such as the PC can be identified.

By employing such a configuration, various kinds of controls such as control regarding the non-collected state prevention function of this embodiment can be also applied for types of jobs (copy job and box job in the above example) other than external jobs accepted from the external apparatus such as the PC in the image forming apparatus 105.

However, it can be said that the problem conceived in the related art described above is mainly a problem which can arise from when an external job accepted from outside is printed.

This is because if considering a job such as a copy job or box print job, for example, the user desiring a printed matter is generally a user who performs operation on the operation portion 203. Namely, basically, a user receiving a printed matter is present in front of the apparatus 105. Also, it can be said that the user more often waits in front of the apparatus until print is completed. In other words, it can be said that for such a type of job, there are not many cases where the printed matter is left standing on the sheet discharging portion.

Therefore, as a configuration of this embodiment, the apparatus 105 is controlled by the control portion 202 to process an external job as a job to be controlled by the non-collected state prevention function. The apparatus 105 is controlled to process a type of job other than the external job, such as a copy job or print, as a job which is not controlled by the non-collected state prevention function. Such a configuration is also acceptable. As one example thereof, for example, if an external job is processed, control such as controls 4 to 7 of FIG. 18 described later is performed. In the case of the copy job and box job, control is performed so as not to perform control such as controls 4 to 7 of FIG. 18 described later.

However, the user collecting a printed matter is not necessarily present in front of the apparatus just because of this type of job.

Then, this configuration is further developed into a configuration in which whether the non-collected state prevention function is enabled or disabled can be registered in advance via a user interface unit for each of a plurality of types of jobs such as the copy job, external print job and box job. For example, ON/OFF of the non-collected state prevention function can be set for each type of job via a registration setting screen regarding the non collected-state prevention function as in FIG. 7. Control is performed so that the operation by the non-collected state prevention function can be performed by the apparatus 105 for each type of job according to the setting of registration of the non-collected state prevention function by the user. Such a configuration is also acceptable.

This can further improve the effect of this embodiment, i.e. an effect making it possible to construct a convenient environment flexibly coping with an environment in which the apparatus is used.

Description gets back to explanation of FIG. 18.

At the time of a.m. 9:05, the control portion 202 starts print processing of the job A from the user A by the printer portion 208. Assume that another job is input during the print operation of the job A. The job is a first job B from a user B input at a.m. 9:10 in FIG. 18.

If such a situation occurs, the control portion 202 confirms that the job A is now being printed based on status information from the printer portion 208. Therefore, the control portion 202 withholds print processing of the job B. For example, print data of the newly accepted job B is sequentially stored in the storage portion 204 in parallel with (concurrently with) processing of reading out print data of the job A from the hard disk of the storage portion 204 and printing the same.

Such control can be performed by the control portion 202. This corresponds to control 2 at the time of a.m. 9:10 in FIG. 18.

Assume that print processing of the job A is completed. It is at the time of a.m. 9:15. In response to the completion of print processing of the job A, the control portion 202 starts print processing of the job B with print data already accumulated in the hard disk by the printer portion 208.

As of this time, the printed matter of the job A has been discharged onto the sheet discharging portion of the image forming apparatus 105. However, as of this time of a.m. 9:15, the printed matter of the job A is uncollected by the user A.

The control portion 202 confirms that print processing of the job B has been completed from status information from the printer portion 208. This is at the time of a.m. 9:20.

As of this time of a.m. 9:20, the printed matter of the job B has been discharged onto the sheet discharging portion of the image forming apparatus 105. However, as of this time of a.m. 9:20, the printed matter of the job B is still uncollected by the user B. Furthermore, the printed matter of the job A is also uncollected.

Assume that the printed matters of the jobs A and B are uncollected from the discharging portion of the image forming apparatus 105 in this way, and further a new job is input to the image forming apparatus 105. This new job is a job C input at the time of a.m. 9:25.

At this time of a.m. 9:25, there is no job for which print is performed by the printer portion 208. This is so called a printable state (also referred to as print ready state or idling state). Furthermore, assume that resources (e.g. consumables such as toners and output sheets) necessary for print processing of the job C are ready for use. Namely, the current state of the image forming apparatus 105 is a state in which print processing of the job C can be performed by the printer portion 208.

The status checked by the control portion 202 is same as the status for the job A at the time of a.m. 9:05. However, the control portion 202 prohibits the apparatus 105 from performing print processing of the job C at the time of a.m. 9:25 based on the fact that the non-collected state prevention function is ON and the checking results described below.

If the non-collected state prevention function is selected as an operation mode, the control portion 202 analyzes job information of the new job C input at a.m. 9:25. As a result, the control portion 202 confirms that this job C is a job from the user A who has input the job A already input to the apparatus 105 before inputting the job C. In other words, the job C is a second job from the user A identical to the user who has input the job A.

At this time of a.m. 9:25, the control portion 202 checks whether or not the printed matter of the already printed job A of the user A has been collected from the sheet discharging portion of the apparatus 105 by, for example, the method of the above-mentioned embodiment. As a result, the control portion confirms that the printed matter of the job A is uncollected. The control portion 202 prohibits (inhibits) performance of print processing of the job C corresponding to the second job from the user A identical to the user who has input the job A based on the checking result.

In this way, print processing of the job C can be performed by the printer portion 208 at the time of a.m. 9:25. However, according to the fact that the non-collected state prevention mode is ON and the job A of the user A corresponding to the user identical to the user of the job C is uncollected from the sheet discharging portion, the control portion 202 prohibits (inhibits) performance of print processing of the job C at this time. Such control can be performed by the control portion 202. This corresponds to control 4 during a time period of the "state in which the printed matter of the job A is uncollected" shown in FIG. 18 including the time of a.m. 9:25 in FIG. 18. The control portion 202 holds in the hard disk of the storage portion 204 the data of the job C in a state in which performance of print processing is prohibited, and withholds print processing of the job C from being performed. This corresponds to control 6.

Assume that a new job is further input after the job C. This new job is a job D input at the time of a.m. 9:27.

At this time of a.m. 9:27, there is no job for which print is performed by the printer portion 208. This is so called a printable state (also referred to as print ready state or idling state). Furthermore, assume that resources (e.g. consumables such as toners and output sheets) necessary for print processing of the job D are ready for use. Namely, the current state of the image forming apparatus 105 is a state in which print processing of the job D can be performed by the printer portion 208.

However, as in the case of treatment of the job C, the control portion 202 prohibits (inhibits) the apparatus 105 from performing print processing of the job D at the time of a.m. 9:27 based on the fact that the non-collected state prevention function is ON and the checking results described below.

If the non-collected state prevention function is selected as an operation mode, the control portion 202 analyzes job information of the new job D input at a.m. 9:27. As a result, the control portion 202 confirms that this job D is a job from the user B who has input the job B already input to the apparatus 105 before inputting the job D. In other words, the job D is a second job from the user B identical to the user who has input the job B.

At this time of a.m. 9:27, the control portion 202 checks whether or not the printed matter of the already printed job B of the user B has been collected from the sheet discharging portion of the apparatus 105 by the method of the above-mentioned embodiment or the like. As a result, the control portion confirms that the printed matter of the job B is uncollected. The,control portion 202 prohibits (inhibits) performance of print processing of the job D corresponding to the second job from the user B identical to the user who has input the job B based on the checking result.

In this way, print processing of the job D can be performed at the time of a.m. 9:27. However, according to the fact that the non-collected state prevention mode is ON and the job B of the user B corresponding to the user identical to the user of the job D is uncollected from the sheet discharging portion, the control portion 202 prohibits (inhibits) performance of print processing of the job D at this time. Such control can be performed by the control portion 202. This corresponds to control 5 during a time period of the "state in which the printed matter of the job B is uncollected" shown in FIG. 18 including the time of a.m. 9:27 in FIG. 18. The control portion 202 holds in the hard disk of the storage portion 204 the data of the job D in a state in which performance of print processing is prohibited, and withholds print processing of the job C from being performed. This corresponds to control 7.

Assume that a new job is further input after the job D. This new job is a job E input at the time of a.m. 9:30.

At this time of a.m. 9:30, there is no job for which print is performed by the printer portion 208. This is so called a printable state (also referred to as print ready state or idling state). Furthermore, assume that resources (e.g. consumables such as toners and output sheets) necessary for print processing of the job E are ready for use. Namely, the current state of the image forming apparatus 105 is a state in which print processing of the job E can be performed by the printer portion 208.

Here, the control portion 202 performs control different from controls 4 to 7. For example, the control portion 202 permits performance of print processing of the job E at the time of a.m. 9:30 based on the fact that the non-collected state prevention function is ON, and the checking result described below.

If the non-collected state prevention function is selected as an operation mode, the control portion 202 analyzes job information of the new job E input at a.m. 9:30. As a result, the control portion 202 confirms that the job E is not a job of the user A or user B, but a job of the user C. In other words, the job E is not a job from the user A or user B whose printed matter is uncollected, but a job from the user C.

At this time of a.m. 9:30, the control portion 202 checks whether or not the printed matter has been already collected from the sheet discharging portion of the apparatus 105 as a job of the user C by the method of the above-mentioned embodiment or the like. As a result, the control portion 202 confirms that there is no printed matter which is uncollected from the sheet discharging portion as a printed matter of the job C. The control portion 202 permits performance of print processing of the job E based on this checking result.

In this way, at the time of a.m. 9:30, print processing of the job D can be performed by the printer portion 208. The non-collected state prevention mode is ON, and there is no printed matter which is uncollected from the sheet discharging portion as a printed matter of a job from a user identical to the user C of the job E. Therefore, the control portion 202 permits performance of print processing of the job E at this time. Such control can be performed by the control portion 202. This is control 8 at the time of a.m. 9:30 in FIG. 18. The control portion 202 makes the printer portion 208 print the print data for which performance of print processing is permitted, under print processing conditions set by the user C, via the hard disk of the storage portion 204 at the time of a.m. 9:30.

The controls described above will be summarized. The control portion 202 performs the following control as a job processing method in the image forming system including the image forming apparatus 105 capable of accepting a plurality of jobs, for example.

At a.m. 9:05, print processing of the job A being a first job from the user A is performed by the image forming apparatus 105. This is based on the fact that print processing of the job A can be performed by the apparatus 105 under a non-collected mode, and the printed matter (a bundle of printed sheets) of the user A is not uncollected from the sheet discharging portion at the time of a.m. 9:05 (control 1).

However, performance of print processing of the job C corresponding to the second job of the user A, which is input at the time of a.m. 9:25 after the job A is input, is prohibited although print processing of the job C can be performed by the apparatus 105 at the time of a.m. 9:25. This is based on the fact that the non-collected mode is ON, and the result of checking the collection state in which the printed matter (a bundle of printed sheets) of the job A of the user A is uncollected from the sheet discharging portion at the time of a.m. 9:25 (control 4).

The control portion 202 performs such job control for the first job A and the second job C from the same user A.

When the job B is input during the print operation of the job A, the control portion 202 sequentially stores data of the job B in the hard disk of the storage portion 204 in parallel with the print operation of the job A. Print processing of the job B is withheld until print of the job A is completed (control 2).

At a.m. 9:15, print processing of the job B being a first job from the user B is performed by the apparatus 105. This is based on the fact that print processing of the job B can be performed by the apparatus 105 under the non-collected mode and the printed matter (a bundle of printed sheets) of the user B is not uncollected from the sheet discharging portion at the time of a.m. 9:15 (control 3).

However, performance of print processing of the job D corresponding to the second job of the user B, which is input at the time of a.m. 9:27 after the job B is input, is prohibited although print processing of the job D can be performed by the apparatus 105 at the time of a.m. 9:27. This is based on the fact that the non-collected mode is ON, and the result of checking the collection state in which the printed matter (a bundle of printed sheets) of the job B of the user B is uncollected from the sheet discharging portion at the time of a.m. 9:27 (control 5).

The control portion 202 performs such job control for the first job B and the second job D from the same user B.

In this way, in this embodiment, performance of print processing of a succeeding job corresponding to the job of a user identical to the user of a job input earlier (preceding job) is prohibited based on checking information related to the state of collection of the sheet of the preceding job from the sheet discharging portion although print processing of the succeeding job can be performed.

Print processing of the job E of the user C newly input at the time of a.m. 9:30 after a plurality of jobs are input in the order of job C to job D is permitted to be performed at the time of a.m. 9:30. This is based on the fact that print processing of the job E can be performed by the apparatus 105 under the non-collected mode and the printed matter (a bundle of printed sheets) of the user C is not uncollected from the sheet discharging portion at the time of a.m. 9:30 (control 8).

Then, assume that during the print operation of the job E, the control portion 202 confirms checking information indicating that the user B has collected the printed matter of the job B from the sheet discharging portion by, for example, the method of the above-mentioned embodiment. This is at the time of a.m. 9:35 in FIG. 18.

If the sheet of the preceding job B which has been discharged is collected from the sheet discharging portion in this way, the control portion 202 performs control so as to permit performance of print processing of the succeeding job D corresponding to the job of the user B identical to the user of the preceding job B. However, as of the time of a.m. 9:35 at which the sheet is collected, print of the job E has not been completed yet. Therefore, the control portion 202 starts print processing of data of the second job D of the user B already held in the hard disk after print of the job E of the user C is completed. This is control 9 in FIG. 18 which is performed by the control portion 202 during a time period after the printed matter of the job B of the user B is collected from the sheet discharging portion.

Assume that during the print operation of the job D, the control portion 202 confirms checking information indicating that the user A has collected the printed matter of the job A from the sheet discharging portion by, for example, the method of the above-mentioned embodiment. This is at the time of a.m. 9:45 in FIG. 18.

If the sheet of the preceding job A which has been discharged is collected from the sheet discharging portion in this way, the control portion 202 performs control so as to permit performance of print processing of the succeeding job C corresponding to the job of the user A identical to the user of the preceding job A. However, as of the time of a.m. 9:45 at which the sheet is collected, print of the job D has not been completed yet. Therefore, the control portion 202 starts print processing of data of the second job C of the user A already held in the hard disk after print of the job D of the user B is completed. This is control 10 in FIG. 18 which is performed by the control portion 202 during a time period after the printed matter of the job A of the user A is collected from the sheet discharging portion.

Here, print timing of the job C of the user A is compared with print timing of the job D of the user B. The job C of the user A was input to the image forming apparatus 105 earlier than the job D of the user B. However, the printed matter of the job B was collected from the sheet discharging portion before the printed matter of the job A was collected from the sheet discharging portion. The printed matter of the job A was collected at a.m. 9:45 30 minutes after print was completed at a.m. 9:15. The printed matter of the job B was collected at a.m. 9:35 15 minutes after print was completed at a.m. 9:20. In this way, the interval (15 minutes) between the end of print of the job B and the collection of the printed matter of the job B is shorter than the interval (30 minutes) between the end of print of the job A and the collection of the printed matter of the job A. Based on such checking information, the control portion 202 performs control so that print of the job D input after the job C is performed prior to the job C.

In this way, in this embodiment, print processing of the new job D related to the user B who has collected the discharged sheet from the sheet discharging portion can be performed by the apparatus 105 prior to print processing of the new job C related to the user A who has not collected the sheet discharged in the sheet discharged portion therefrom.

Other jobs can be accepted and sequentially stored in the hard disk whenever necessary while performing such job control. This is control 11 in FIG. 18.

Various kinds of controls described above are performed when the non-collected state prevention mode is set.

The jobs (A, B, C, D, E) of the users A to C are processed according to the schedule shown in FIG. 18, but by performing the control in FIG. 18, for example, the following effect can be obtained.

For example, performance of print of the job C of the user A was prohibited due to the fact that the user A had not collected the printed sheet of the preceding job A of the user A from the sheet discharging portion. Similarly, performance of print of the job D of the user B was prohibited due to the fact that the user B had not collected the printed sheet of the preceding job B of the user B from the sheet discharging portion. As a result, print of these jobs was prohibited, and print of the job E input after these jobs was performed.

In this embodiment, these jobs input in the order of job C to job D to job E are printed in the order of job E to job D to job C. However, print of the jobs D and C is permitted because the users of these jobs have collected the printed matter of the preceding job. In other words, it does not mean that only if print of jobs now being printed in advance is completed, print of these jobs is automatically started. Namely, print of the job is not simply put off with its order of priority of print lowered, but the print is prohibited until collection processing is performed.

Consider a configuration in which the order of priority of print is simply lowered, and performance of a new job from a user who has not collected a printed matter is permitted irrespective of the collection state of the sheet of a preceding job. For example, consider a configuration in which print of the jobs C and D is simply put off, and print of the jobs C and D is started as soon as print of the job E is completed despite the fact that printed matters of the job A of the user A and the job B of the user B have not been collected.

It is conceivable that in the configuration in which the order of priority of a succeeding job is simply lowered according to the collection state of a printed matter of a preceding job in this way, it is difficult to cope with the problems described below.

For example, assume that the users A and B habitually leave a printed matter standing for a long time. In the configuration the order of priority is simply lowered as described above, print of the jobs C and D is merely put off and the print itself is not prohibited. Therefore, as long as such users exist, the problem described in "Related Background Art" eventually arises. In addition, because the users A and B are in the habit of leaving a printed matter standing in the first place, the effect of deterring the users A and B from leaving the printed matter non-collected is not exhibited if print of the jobs C and D is simply put off.

It can be said that as security enhancement has become increasingly important in recent years, leaving a printed matter standing for a long time should be prevented wherever possible. For this purpose, it is believed that users who habitually leave a printed matter standing for a long time need to improve their awareness. However, in the configuration in which the order of priority is simply lowered as described above, it is difficult to cope with these problems.

Thus, as one example of this embodiment, a mechanism as in the example of control in FIG. 18 is also incorporated so that the problems described above can be coped with.

For other controls, controls based on the embodiments described above are performed. For example, in this embodiment, as in the embodiments described above, the number limit of a job can be set, but performance of print processing of a succeeding job accepted by the image forming apparatus 105 after the number limit of the job is exceeded is prohibited according to the collection state of the sheet of a preceding job discharged onto the sheet discharging portion. However, a job accepted by the apparatus 105 before the number limit of the job is exceeded is subjected to print processing according to the order of input.

If the job E in FIG. 18 is a job having a number of pages equal to or greater than a predetermined number of pages (e.g. 100 pages), print processing of the job E is prohibited from being automatically performed at the time of a.m. 9:30 even though it can be performed by the image forming apparatus 105. In this case, data of the job E is stored in the hard disk. An instruction to start print of the job E is input via the operation portion 203 of the apparatus 105, upon which print of the job E is started.

If the job E in FIG. 18 is a job of which the number of pages is less than a predetermined number of pages (e.g. 100 pages), print processing of the job E is permitted to be automatically performed at the time of a.m. 9:30. Namely, even though the user does not operate the operation portion after data of the job E is stored in the hard disk, print can be automatically performed.

In this way, various kinds of controls including the above-mentioned controls 1 to 11 can be performed by the control portion 202 if the non-collected state prevention function is ON.

In other words, the control portion 202 performs control so that at least the above-mentioned controls 4 and 5 are not performed if the non-collected state prevention function is not selected (it is OFF).

For example, if the function is OFF, control is performed so that a plurality of jobs, i.e. the jobs A to E, are printed in an order identical to the order of input of the jobs.

Print processing of the job A is performed at the time of a.m. 9:05. Print of the job B of the user B is started at the time of a.m. 9:15 corresponding to a time at which print of the job A of the user A is started. Print of the job C of the user A is started at the time of a.m. 9:25 corresponding to a time at which the job C is input irrespective of whether the printed matter of the job A of the user A is uncollected or not. Print of the job D of the user B input at a.m. 9:27 is started at the time when print of the job C of the user A is completed, irrespective of whether the printed matter of the job B of the user B is uncollected or not.

In this way, the control portion 202 controls the image forming apparatus 105 so that the jobs A to E can be printed in the order of input if the non-collected state prevention function is not selected.

When an operation to switch the non-collected state prevention function from ON to OFF is performed by the user via the user interface unit if the non-collected state prevention function is ON and there is a job for which performance of print processing is prohibited by the function, control is performed in the manner described below.

For example, at the time of a.m. 9:27 in FIG. 18, there are the job C of the user A and the job C of the user B as jobs for which performance of print processing is prohibited. Print data of these jobs are held in the hard disk of the storage portion 204. The control portion 202 at least withholds print of the job C until the job A of the user A is collected from the sheet discharging portion. Print of the job D is at least withheld until the job B of the user B is collected from the sheet discharging portion. The image forming apparatus 105 is currently in a state in which the non-collected state prevention function is ON (enabled)

Here, the key 711 on the screen 710 of FIG. 7 displayed on the display portion 301 of the image, forming apparatus 105 is operated by the user to turn the non-collected state prevention function-OFF (disabled) at the time of a.m. 9:28. Then, the control portion 202 cancels the non-collected state prevention function in response to the setting by the user.

Specifically, the control portion 202 permits both performance of print of the job C and performance of print of the job D.

For example, print data of the job C is read out from the hard disk and print processing of the job C withheld from being performed in control 4 is performed in response to the non-collected state prevention function being switched from ON to OFF at the time of a.m. 9:28. When print of the job C is completed, print data of the job D is read out from the hard disk, and print processing of the job D withheld from being performed in control 5 is performed. When print of the job D is completed, print of the job E of the user C is started. Jobs are performed in this order.

Namely, when the above operation is done, performance of print of the succeeding job C of the user A is permitted irrespective of whether or not the printed matter of the preceding job A of the user A has been collected from the sheet discharging portion. Similarly, performance of print of the succeeding job D of the user B is permitted irrespective of whether or not the printed matter of the preceding job B of the user B has been collected from the sheet discharging portion.

As described above, the image forming apparatus 105 is controlled by the control portion 202 so that print processing of the job for which performance of print processing is prohibited when the non-collected state prevention mode is selected (ON) can be performed in response to the setting of the non-collected state prevention mode being cancelled (OFF).

Control like controls 4 to 7 in FIG. 18 is performed when an external job is processed if a plurality of types jobs such as the external job, the copy job and the box job can be accepted as in the image forming apparatus 105. In the case of the copy job and the box job, control is performed so as not to perform control like controls 4 to 7. Such a configuration is acceptable as described above.

A request for starting print of the external job is input via, for example, the operation of an external apparatus such as a host computer. Namely, it can be said that there are not many cases where the user is present in front of the apparatus from a time before print is started. A request for starting print of the copy job, box job or the like is input via the operation portion 203 of the apparatus itself. Namely, the user is often present in front of the apparatus 105 from a time before print is started.

If a type of job with a print start request input via a user interface unit of an external apparatus different from the image forming apparatus 105 (also referred to as first type of job) such as, for example, an external job is processed, the job is controlled in the manner described below.

For example, whether or not there is a job which is a job of a user identical to the user of the external job, has been already printed and is uncollected from the sheet discharging portion is checked. If as a result, there is a job which is a job of a user identical to the user of the job, has been printed and is uncollected from the sheet discharging portion, performance of print of the external job is prohibited even if the external job can be printed by the apparatus 105. If a job which is a job of a user identical to the user of the external job, has been printed and is uncollected does not exist, performance of print of the external job is permitted.

If a type of job with a print start request input via a user interface unit of an external apparatus possessed by the image forming apparatus 105 (also referred to as second type of job) such as, for example, a copy job and a box job is processed, the job is controlled in the manner described below.

For example, if the second type of job is processed, processing of checking whether or not there is a job which is a job of a user identical to the user of the job, has been already printed and is uncollected from the sheet discharging portion, or the like is not performed. Moreover, performance of print processing of the accepted second type of job is permitted irrespective of whether or not there is a job which is a job of the user and is uncorrected in the sheet discharging portion. In other words, even if there is a job which is a job of the user and is uncollected in the sheet discharging portion, performance of print processing of the second job is permitted.

Control may be performed by the control portion 202 such that control is performed differently for the first type of job and the second type of job.

In this way, this embodiment can employ various kinds of applied controls.

By employing the configuration described above, the problem conceived in "Related Background Art" can be coped with. For example, even if two or more persons share one image forming apparatus without increasing either the size of the image forming apparatus or the cost, job outputs (print sheets) are prevented from being left non-collected on the sheet-discharging tray. Each user can easily acquire (collect) his or her job output (print sheet) reliably. In this way, a convenient environment flexibly coping with an environment in which the apparatus of this embodiment is used can be constructed. Such effects can be provided.

Configurations having combinations of the above-mentioned embodiments and alterations thereof are all included in the present invention.

The configurations and contents of various kinds of data in FIGS. 8 to 11 and 13 are not limited to those shown therein, but they consist of a variety of configurations and contents according to applications and purposes as a matter of course.

The embodiments have been described above, but the present invention can take an implementation as, for example, a system, apparatus, method, program, storage medium or the like, and specifically it may be applied to a system constituted by a plurality of devices, or may be applied to an apparatus constituted by one device.

The configuration of a data processing program readable by the image forming apparatus according to the present invention will be described below with reference to a memory map shown in FIG. 19.

FIG. 19 is a view explaining a memory map of a storage medium (recording medium) storing various kinds of data processing programs readable by the image forming apparatus according to the present invention.

Although not particularly shown in the figure, there are cases where information for managing a group of programs stored in the storage medium, e.g. version information, a creators and the like is stored, and information dependent on an OS or the like reading programs, e.g. icons identifiably displaying programs, and the like is stored.

Further, data dependent on various kinds of programs is managed by the directory. There are cases where programs for installing various kinds of programs in a computer, and programs for decompressing programs to be installed when such programs are compressed are stored.

The function shown in FIGS. 12A and 12B in this embodiment may be accomplished by the host computer with a program installed from outside. In this case, the present invention is applied even when information group including programs is supplied to an output apparatus by a storage medium such as a CD-ROM, flash memory or FD or an external storage medium via a network.

A recording medium recording a program code of software realizing the function of the embodiment described above is supplied to a system or apparatus, and a computer (or CPU or MPU) of the system or apparatus reads out and executes the program code stored in the storage medium, whereby the object of the present invention is achieved as a matter of course.

In this case, the program code itself read out from the storage medium realizes a new function of the present invention, and the storage medium storing the program code constitutes the present invention.

Thus, as long as the function of the program is provided, an object code, a program executed by an interpreter or script data supplied to the OS is acceptable.

For the storage medium for supplying a program, for example, flexible disks, hard disks, optical disks, magneto-optical disks, MOs, CD-ROMs, CD-Rs, CD-RWs, magnetic tapes, nonvolatile memory cards, ROMs, DVDs and the like may be used.

In this case, the program code itself read out from the storage medium realizes the function of the embodiment described above, and the storage medium storing the program code constitutes the present invention.

In addition, for the method for supplying a program, the program can be supplied by establishing connection to a homepage of an internet using a browser of a client computer, and downloading a computer program itself of the present invention or a file compressed and including an automatic installation function to a storage medium such as a hard disk from the homepage. The function of the embodiment can also be realized by dividing the program code constituting the program of the present invention into a plurality of files and downloading the files from different homepages. Namely, a WWW server, an ftp server and the like allowing users to download program files for realizing functional processing with a computer are also included in claims of the present invention.

The function of the embodiment can also be realized by encoding the program of the present invention and storing the same in a storage medium such as a CD-ROM, allowing a user satisfying a predetermined condition to download key information for solving the encoding from the homepage via the internet, and executing the encoded program by using the key information to install the program in the computer.

Not only the case where the program code read out by the computer is executed, whereby the function of the embodiment described above is realized, but also the case where based on the instruction of the program code, the OS (operating system) or the like running on the computer performs part or all of actual processing, whereby the function of the embodiment described above is realized is included in the present invention as a matter of course.

Further, the case where the program code read out from the storage medium is written into a memory provided in a feature expansion board inserted in the computer or a feature expansion unit connected to the computer, and based on the instruction of the program code, a CPU or the like provided in the feature expansion board or feature expansion unit performs part or all of actual processing, whereby the function of the embodiment described above is realized is also included in the present invention as a matter of course.

The present invention may be applied to a system constituted by a plurality of devices, or may be applied to an apparatus constituted by one device. The present invention may also be applied to the case where it is achieved by supplying a program to a system or apparatus. In this case, a storage medium storing program represented by software for achieving the present invention is read out onto the system or apparatus, whereby the system or apparatus can be given the effect of the present invention.

The present invention is not limited to the above-mentioned embodiments, various alterations (including organic combinations of embodiments) can be made based on the sprit of the present invention, and they are not excluded from the scope of the present invention.

Various examples and embodiments of the present invention have been described, but the sprit and scope of the present invention should not be limited to specific description within this specification as apparent to those skilled in the art.

This application claims priority from Japanese Patent Application No. 2004-232849 filed on Aug. 10, 2004, which is hereby incorporated by reference herein.

What is claimed is:

1. A job processing method of an image forming system including an image forming apparatus capable of accepting a plurality of jobs including a first job, comprising the steps of:

causing said image forming apparatus to perform a print processing of the first job; and enabling prohibition of an execution of a print processing of a second job input after said first job based on checking information including at least any one of information associated with said first job subjected to said print processing and information associated with said second job although said print processing of said second job can be performed by said image forming apparatus, wherein said image forming apparatus discharges a sheet of print-processed data of said first job to a sheet discharging destination, and wherein, in said method, print processing of a new job associated with a user having collected from said sheet discharging destination the sheet discharged to said sheet discharging destination can be performed by said image forming apparatus prior to print processing of a new job associated with a user not having collected from said sheet discharging destination the sheet discharged to said sheet discharging destination.

2. The method according to claim 1, wherein said image forming apparatus discharges a sheet of print-processed data of said first job to a sheet discharging destination, and in said method, performance of print processing of said second job can be prohibited based on checking information associated with the sheet of said first job discharged to said sheet discharging destination although print processing of said second job can be performed by said image forming apparatus.

3. The method according to claim 2, wherein in said method, performance of print processing of said second job as a job of a user identical to the user of said first job is prohibited based on checking information associated with a collection state of the sheet of said first job discharged to said sheet discharging destination although print processing of said second job can be performed by said image forming apparatus.

4. The method according to claim 2, wherein in said method, performance of print processing of said second job is permitted if the sheet of said first job discharged to said sheet discharging destination is already collected from said sheet discharging destination, and performance of print processing of said second job is prohibited although print processing of said second job can be performed by said image forming apparatus if the sheet of said first job discharged to said sheet discharging destination is uncollected from said sheet discharging destination.

5. The method according to claim 2, wherein in said method, further, a predetermined operation mode can be set, and in said method, an operation of prohibiting performance of print processing of a new job of a user associated with the job can be performed based on information associated with the sheet of the job in said sheet discharging destination if said predetermined operation mode is set.

6. The method according to claim 2, wherein in said method, further, a number limit of a job can be set, and in said method, performance of print processing of said second job as a job accepted by said image forming apparatus after the number limit of said job is exceeded is prohibited based on information associated with the sheet of said first job discharged to said sheet discharging destination, and performance of print processing of a third job as a job accepted by said image forming apparatus before the number limit of said job is exceeded is permitted.

7. The method according to claim 6, wherein in said method, the number limit of the job can be set for each of a plurality of users including the first user, performance of print processing of said second job as a job of said first user newly accepted by said image forming apparatus after the number limit of the job of said first user is exceeded is prohibited based on information associated with the sheet of said first job as a job of said first user discharged to said sheet discharging destination, and performance of print processing of the third job as a job of said first user newly accepted by said image forming apparatus before the number limit of the job of said first user is exceeded is admitted.

8. The method according to claim 1, wherein in said method, print processing of a fourth job as a new job associated with the first user having collected from said sheet discharging destination the sheet of a third job discharged to said sheet discharging destination is performed by said image forming apparatus prior to print processing of said second job as a new job associated with a second user not having collected from said sheet discharging destination the sheet of said first job discharged to said sheet discharging destination.

9. The method according to claim 1, wherein in said method, performance of print processing of said second job can be prohibited based on checking information on whether or not the number of pages of said second job is equal to or greater than a predetermined number of pages although print processing of said second job can be performed by said image forming apparatus.

10. The method according to claim 9, wherein in said method, performance of print processing of said second job is prohibited although print processing of said second job can be performed by said image forming apparatus if said second job is a job having a number of pages greater than a predetermined number of pages, and performance of print processing of said second job is permitted if said second job has a number of pages equal to or less than a predetermined number of pages.

11. The method according to claim 9, wherein in said method, further, a predetermined operation mode can be set, and in said method, an operation of prohibiting performance of print processing of said second job based on checking information on whether the number of pages of said second job is equal to or greater than a predetermined number of jobs can be performed if said predetermined operation is set.

12. The method according to claim 1, wherein in said method, print processing of another job can be performed by said image forming apparatus during a time period over which performance of print processing of said second job is prohibited.

13. The method according to claim 1, wherein in said method, data of said second job can be stored in a storage unit possessed by said image forming apparatus even if performance of print processing of said second job is prohibited.

14. The method according to claim 1, wherein in said method, print processing of said second job for which performance of print processing is prohibited can be performed based on a user operation in said image forming apparatus.

15. The method according to claim 14, wherein said image forming apparatus discharges a sheet of print-processed data of said first job to a sheet discharging destination, and in said method, performance of print processing of said second job is prohibited although print processing of said second job can be performed by said image forming apparatus if the sheet of said first job discharged to said sheet discharging destination is uncollected from said sheet discharging destination by the user, and print processing of said second job for which performance of print processing is prohibited can be performed after the sheet of said first job discharged to said sheet discharging destination is collected from said sheet discharging destination by the user.

16. The method according to claim 14, wherein in said method, performance of print processing of said second job is prohibited although print processing of said second job can be performed by said image forming apparatus if said second job is a job having a number of pages equal to or greater than a predetermined number of pages and a predetermined instruction is not input via a user interface unit of said image forming apparatus, and print processing of said second job for which performance of print processing is prohibited can be performed after the predetermined instruction is input via the user interface unit of said image forming apparatus.

17. The method according to claim 14, wherein in said method, further, a predetermined operation mode can be set, an operation of prohibiting performance of print processing of said second job based on checking information including at least any one of information associated with said first job subjected to said print processing and information associated with said second job although print processing of said second job can be performed by said image forming apparatus is performed if said predetermined operation mode is set, and print processing of said second job for which performance of print processing is prohibited can be performed if the setting of said predetermined operation mode is cancelled.

18. The method according to claim 1, wherein in said method, print processing of at least any one of data of a job from an original reading unit and data of a job from external apparatuses including a computer can be performed by said image forming apparatus.

19. The method according to claim 1, wherein said image forming apparatus can accept, in addition to the external job accepted from the external apparatus, a job different in type from the external job, and in said method, said control can be performed for each of a plurality of types of jobs including the external job and types of jobs other than the external job.

20. The method according to claim 1, wherein the image forming apparatus can accept a first type of job for which a print start request can be input via a user interface unit of an external apparatus different from said image forming apparatus and a second type of job for which a print start request can be input via a user interface unit of said image forming apparatus, can prohibit performance of print processing of said second job if said second job is said first type of job, and the sheet of said first job already printed is uncollected from said sheet discharging destination, and can perform print processing of said second job although the sheet of said first job already printed is uncollected from said sheet discharging destination if said second job is said second type of job.

21. A computer readable storage medium storing a program code for performing the job processing method according to claim 1.

22. An image forming system including an image forming apparatus capable of accepting a plurality of jobs including a first job, comprising:

a printing unit constructed to cause said image forming apparatus to perform a print processing of the first job; and a prohibiting unit constructed to enable prohibition of an execution of a print processing of a second job input after said first job based on checking information including at least any one of information associated with said first job subjected to said print processing and information associated with said second job although said print processing of said second job can be performed by said image forming apparatus, wherein said image forming apparatus discharges a sheet of print-processed data of said first job to a sheet discharging destination, and wherein print processing of a new job associated with a user having collected from said sheet discharging destination the sheet discharged to said sheet discharging destination can be performed by said image forming apparatus prior to print processing of a new job associated with a user not having collected from said sheet discharging destination the sheet discharged to said sheet discharging destination.

23. A job processing method of an image forming system including an image forming apparatus capable of accepting a plurality of jobs including a first job, comprising the steps of:

causing said image forming apparatus to perform a print processing of the first job; and enabling prohibition of an execution of a print processing of a second job input after said first job based on checking information including at least any one of information associated with said first job subjected to said print processing and information associated with said second job although said print processing of said second job can be performed by said image forming apparatus, wherein said image forming apparatus discharges a sheet of print-processed data of said first job to a sheet discharging destination, and wherein, in said method, print processing of a third job as a new job associated with a user having collected from said sheet discharging destination the sheet discharged to said sheet discharging destination can be started by said image forming apparatus before print processing of the third job as a new job associated with a user not having collected from said sheet discharging destination the sheet discharged to said sheet discharging destination is performed.

24. The method according to claim 23, wherein in said method, print processing of a fourth job as a new job associated with the first user having collected from said sheet discharging destination the sheet of the third job discharged to said sheet discharging destination is started by said image forming apparatus before print processing of said second job as a new job associated with a second user not having collected from said sheet discharging destination the sheet of said first job discharged to said sheet discharging destination is performed.

25. A computer readable storage medium storing a program code for performing the job processing method according to claim 23.

26. A job processing method of an image forming system including an image forming apparatus capable of accepting a plurality of jobs including a first job, comprising the steps of:

causing said image forming apparatus to perform a print processing of the first job; and enabling prohibition of an execution of a print processing of a second job input after said first job based on checking information including at least any one of information associated with said first job subjected to said print processing and information associated with said second job although said print processing of said second job can be performed by said image forming apparatus, wherein said image forming apparatus can accumulate a plurality of input print jobs in a storage unit, sequentially perform the same and discharge job outputs of the print jobs to a sheet discharging destination, wherein, in said method, a state of collection of the job outputs of said print jobs from the sheet discharging destination is managed, wherein, when a print job is newly input, user information of the newly input print job is checked, and control is performed so that performance of the newly input print job is limited or permitted based on a state of collection of previously input print jobs corresponding to the user information, and wherein, in said method, performance of the newly input print job is limited if the number of previously input and uncollected print jobs corresponding to the user information of said newly input print jobs is larger than a predetermined number of jobs.

27. The method according to claim 26, wherein in said method, even if performance of the newly input print job is permitted, performance of print processing of the print job is withheld until an instruction to start printing is input if the number of print sheets of the newly input print job is larger than a predetermined number.

28. The method according to claim 26, wherein in said method, a large copy number limit for limiting the print output of a large copy number print job is set, and even if performance of the newly input print job is permitted, performance of print processing is withheld until an instruction to start printing is input if the number of print sheets of the newly input print job is larger than said large copy number limit.

29. The method according to claim 26, wherein in said method, input for indicating that the job output is collected from said discharging destination is done for each print job, and the collection state of the print job for which said input is done is managed as a state in which collection is complete.

30. The method according to claim 26, wherein in said method, collection of the job output from said discharging destination is detected, and when collection of the job output from the discharging destination is detected, which print job the collected job output corresponds to is determined, and the collection state of the print job is determined to be a state in which collection is complete, and managed.

31. The method according to claim 26, wherein in said method, notification processing for indicating next processing to be performed by an operator for the job output of the print job is performed by a user interface unit if said print job is collected.

32. A computer readable storage medium storing a program code for performing the job processing method according to claim 26.

33. An image forming system including an image forming apparatus capable of accepting a plurality of jobs including a first job, comprising:

a printing unit constructed to cause said image forming apparatus to perform a print processing of the first job; and a prohibiting unit constructed to enable prohibition of an execution of a print processing of a second job input after said first job based on checking information including at least any one of information associated with said first job subjected to said print processing and information associated with said second job although said print processing of said second job can be performed by said image forming apparatus, wherein said image forming apparatus can accumulate a plurality of input print jobs in a storage unit, sequentially perform the same and discharge job outputs of the print jobs to a sheet discharging destination, wherein a state of collection of the job outputs of said print jobs from the sheet discharging destination is managed, wherein, when a print job is newly input, user information of the newly input print job is checked, and control is performed so that performance of the newly input print job is limited or permitted based on a state of collection of previously input print jobs corresponding to the user information, and wherein performance of the newly input print job is limited if the number of previously input and uncollected print jobs corresponding to the user information of said newly input print jobs is larger than a predetermined number of jobs.

34. A job processing method of an image forming system including an image forming apparatus capable of accepting a plurality of jobs including a first job, comprising the steps of:

causing said image forming apparatus to perform a print processing of the first job; and enabling prohibition of an execution of a print processing of a second job input after said first job based on checking information including at least any one of information associated with said first job subjected to said print processing and information associated with said second job although said print processing of said second job can be performed by said image forming apparatus, wherein said image forming apparatus can accumulate a plurality of input print jobs in a storage unit, sequentially perform the same and discharge job outputs of the print jobs to a sheet discharging destination, wherein, in said method, a state of collection of the job outputs of said print jobs from the sheet discharging destination is managed, wherein, when a print job is newly input, user information of the newly input print job is checked, and control is performed so that performance of the newly input print job is limited or permitted based on a state of collection of previously input print jobs corresponding to the user information, wherein in said method, a job number limit is set for each piece of user information, and wherein performance of the newly input print job is limited if the number of previously input and uncollected print jobs corresponding to the user information of said newly input print jobs is larger than a job number limit corresponding to said user information.

35. The method according to claim 34, wherein in said method, a state of completion of discharge of job outputs of said print jobs to a discharging destination is managed, interval time after it is determined that discharge of the print job is completed until it is determined that collection of the print job is completed by first state managing means is measured for each piece of user information of the print job, and the job limit number of each piece said user information is changed and set based on said interval time measured by measuring means.

36. The method according to claim 35, wherein in said method, holiday information is registered, and said interval time is measured except for time corresponding to said holiday information.

37. A computer readable storage medium storing a program code for performing the job processing method according to claim 34.

38. An image forming system including an image forming apparatus capable of accepting a plurality of jobs including a first job, comprising:

a printing unit constructed to cause said image forming apparatus to perform a print processing of the first job; and a prohibiting unit constructed to enable prohibition of an execution of a print processing of a second job input after said first job based on checking information including at least any one of information associated with said first job subjected to said print processing and information associated with said second job although said print processing of said second job can be performed by said image forming apparatus, wherein said image forming apparatus discharges a sheet of print-processed data of said first job to a sheet discharging destination, and wherein print processing of a new job associated with a user having collected from said sheet discharging destination the sheet discharged to said sheet discharging destination can be started by said image forming apparatus before print processing of another new job associated with a user not having collected from said sheet discharging destination the sheet discharged to said sheet discharging destination is performed.

39. An image forming system including an image forming apparatus capable of accepting a plurality of jobs including a first job, comprising:

a printing unit constructed to cause said image forming apparatus to perform a print processing of the first job; and a prohibiting unit constructed to enable prohibition of an execution of a print processing of a second job input after said first job based on checking information including at least any one of information associated with said first job subjected to said print processing and information associated with said second job although said print processing of said second job can be performed by said image forming apparatus, wherein said image forming apparatus can accumulate a plurality of input print jobs in a storage unit, sequentially perform the same and discharge job outputs of the print jobs to a sheet discharging destination, wherein a state of collection of the job outputs of said print jobs from the sheet discharging destination is managed, wherein, when a print job is newly input, user information of the newly input print job is checked, and control is performed so that performance of the newly input print job is limited or permitted based on a state of collection of previously input print jobs corresponding to the user information, wherein a job number limit is set for each piece of user information, and wherein performance of the newly input print job is limited if the number of previously input and uncollected print jobs corresponding to the user information of said newly input print jobs is larger than a job number limit corresponding to said user information.

* * * * *

UNITED STATES PATENT AND TRADEMARK OFFICE

CERTIFICATE OF CORRECTION

PATENT NO. : 7,386,246 B2
APPLICATION NO. : 11/200059
DATED : June 10, 2008
INVENTOR(S) : Takashi Yabe It is certified that error appears in the above-identified patent and that said Letters Patent is hereby corrected as shown below:

COLUMN 3:
Line 59, “gas” should read -- has --.

COLUMN 4:
Line 31, “subjected” should read -- subjected to --.

COLUMN 8:
Line 52, “202.performs” should read -- 202 performs --.

COLUMN 10:
Line 48, “may be or” should read -- maybe --; and
Line 66, “be” should be deleted.

COLUMN 11:
Line 25, “shown” should read -- shown in --; and
Line 44, “prevention-function” should read -- prevention function --.

COLUMN 12:
Line 23, “proceeds-directly” should read -- proceeds directly --.

COLUMN 13:
Line 8, ““Jlim(12)=1”” should read -- “JLim(12)=1” --; and
Line 40, “in to” should read -- into --.

COLUMN 14:
Line 2, “completion-status” should read -- completion status --;
Line 18, “114” should read -- S114 --;
Line 25, “that-the” should read -- that the --; and
Line 53, “time.1506” should read -- time 1506 --.

COLUMN 15:
Line 45, “Jlim(X)” should read -- JLim(X) --.

COLUMN 16:
Line 15, “number,.and” should read -- number, and --;
Line 25, “8117.” should read -- S117. --; and
Line 43, “that, it” should read -- that it --.

UNITED STATES PATENT AND TRADEMARK OFFICE

CERTIFICATE OF CORRECTION

PATENT NO. : 7,386,246 B2
APPLICATION NO. : 11/200059
DATED : June 10, 2008
INVENTOR(S) : Takashi Yabe It is certified that error appears in the above-identified patent and that said Letters Patent is hereby corrected as shown below:

COLUMN 17:
Line 48, “ours” should read -- occurs --.

COLUMN 18:
Line 30, “Jlim(X)” should read -- JLim(X) --;
Line 32, “Jlim(X)” should read -- JLim(X) --; and
Line 61, “perform” should read -- performs --.

COLUMN 19:
Line 36, “Jlim(x))” should read -- JLim(X)) --; and
Line 43, “Jlim(X),” should read -- JLim(X), --.

COLUMN 20:
Line 2, “Jlim(X)” should read -- JLim(X) --; and
Line 9, “shown” should read -- shown in --.

COLUMN 21:
Line 37, “FIG,” should read -- FIG. --; and
Line 56, “User” should read -- user --.

COLUMN 24:
Line 61, “The, control” should read -- The control --.

COLUMN 29:
Line 56, “(enabled)” should read -- (enabled). --;
Line 58, “image, forming” should read -- image forming --; and
Line 60, “function-OFF” should read -- function OFF --.

UNITED STATES PATENT AND TRADEMARK OFFICE

CERTIFICATE OF CORRECTION

PATENT NO. : 7,386,246 B2
APPLICATION NO. : 11/200059
DATED : June 10, 2008
INVENTOR(S) : Takashi Yabe It is certified that error appears in the above-identified patent and that said Letters Patent is hereby corrected as shown below:

COLUMN 33:

Line 7, "sprit" should read -- spirit --.

Signed and Sealed this

Twenty-third Day of December, 2008

JON W. DUDAS
*Director of the United States Patent and Trademark Office*